US011833839B2

(12) United States Patent
Suzuki

(10) Patent No.: US 11,833,839 B2
(45) Date of Patent: Dec. 5, 2023

(54) IMAGE PROCESSING APPARATUS AND CONTROL METHOD

(71) Applicant: CANON KABUSHIKI KAISHA, Tokyo (JP)

(72) Inventor: Tetsuya Suzuki, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 42 days.

(21) Appl. No.: 17/832,026

(22) Filed: Jun. 3, 2022

(65) Prior Publication Data

US 2022/0396079 A1 Dec. 15, 2022

(30) Foreign Application Priority Data

Jun. 14, 2021 (JP) ..... 2021-098919

(51) Int. Cl.

| | |
|---|---|
| ***B41J 2/32*** | (2006.01) |
| ***B41J 2/325*** | (2006.01) |
| ***B41J 2/525*** | (2006.01) |
| ***B41J 2/36*** | (2006.01) |

(52) U.S. Cl.

CPC ..... *B41J 2/325* (2013.01); *B41J 2/36* (2013.01); *B41J 2/525* (2013.01)

(58) Field of Classification Search

CPC ..... B41J 2/325; B41J 2/36; B41J 2/525; B41J 29/02; B41J 29/00; B41J 29/38; B41J 29/13; B41J 2/32

See application file for complete search history.

(56) References Cited

U.S. PATENT DOCUMENTS

| | | | | |
|---|---|---|---|---|
| 11,691,434 | B2 * | 7/2023 | Ogawa | B41J 2/355 347/14 |
| 2013/0300790 | A1 * | 11/2013 | Ojiro | B41J 2/07 347/14 |
| 2015/0002602 | A1 * | 1/2015 | Hashimoto | B41J 35/04 347/214 |
| 2017/0187913 | A1 * | 6/2017 | Suzuki | B41M 5/382 |

FOREIGN PATENT DOCUMENTS

JP 2013-111951 A 6/2013

* cited by examiner

*Primary Examiner* — Kristal Feggins
(74) *Attorney, Agent, or Firm* — Cowan, Liebowitz & Latman, P.C.

(57) ABSTRACT

An image processing apparatus that generates overcoat transfer data for transferring an overcoat onto an image formed on a recording sheet, generates a line image to be added to the overcoat, and converts the line image into a drawing part to be added to the overcoat. The drawing part includes an outline part and an area inside the outline part, the outline part is formed from pixels having a first glossiness, the area inside the outline part is formed as a mixed pattern part in which pixels having the first glossiness and pixels having a second glossiness higher than the first glossiness are mixed, and the area outside the outline part is formed from pixels having the second glossiness.

14 Claims, 17 Drawing Sheets

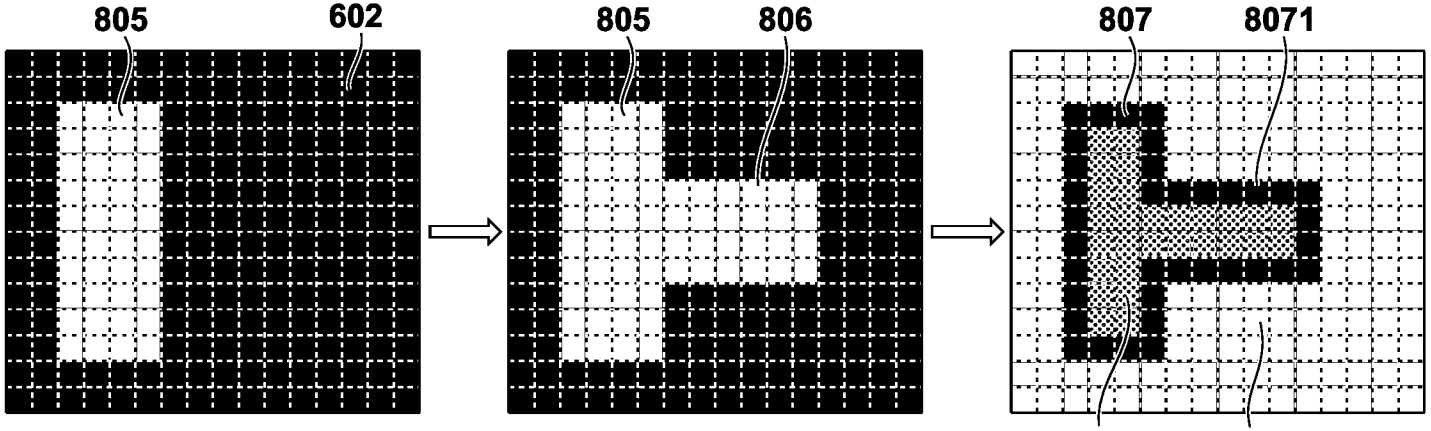
FIG. 8A1
FIG. 8A2
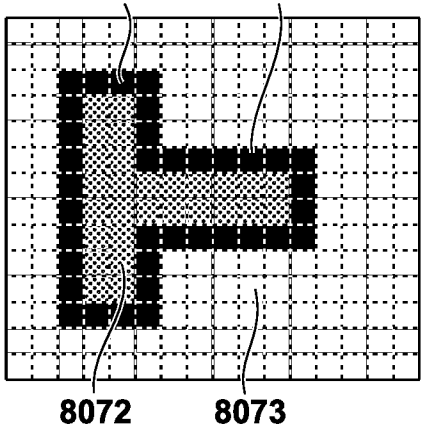
FIG. 8A3
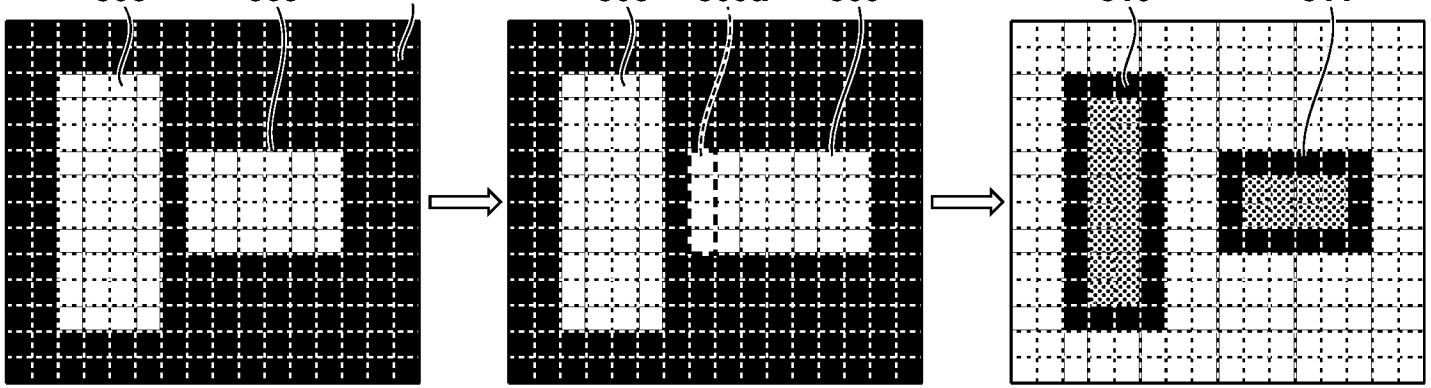
FIG. 8B1
FIG. 8B2
FIG. 8B3

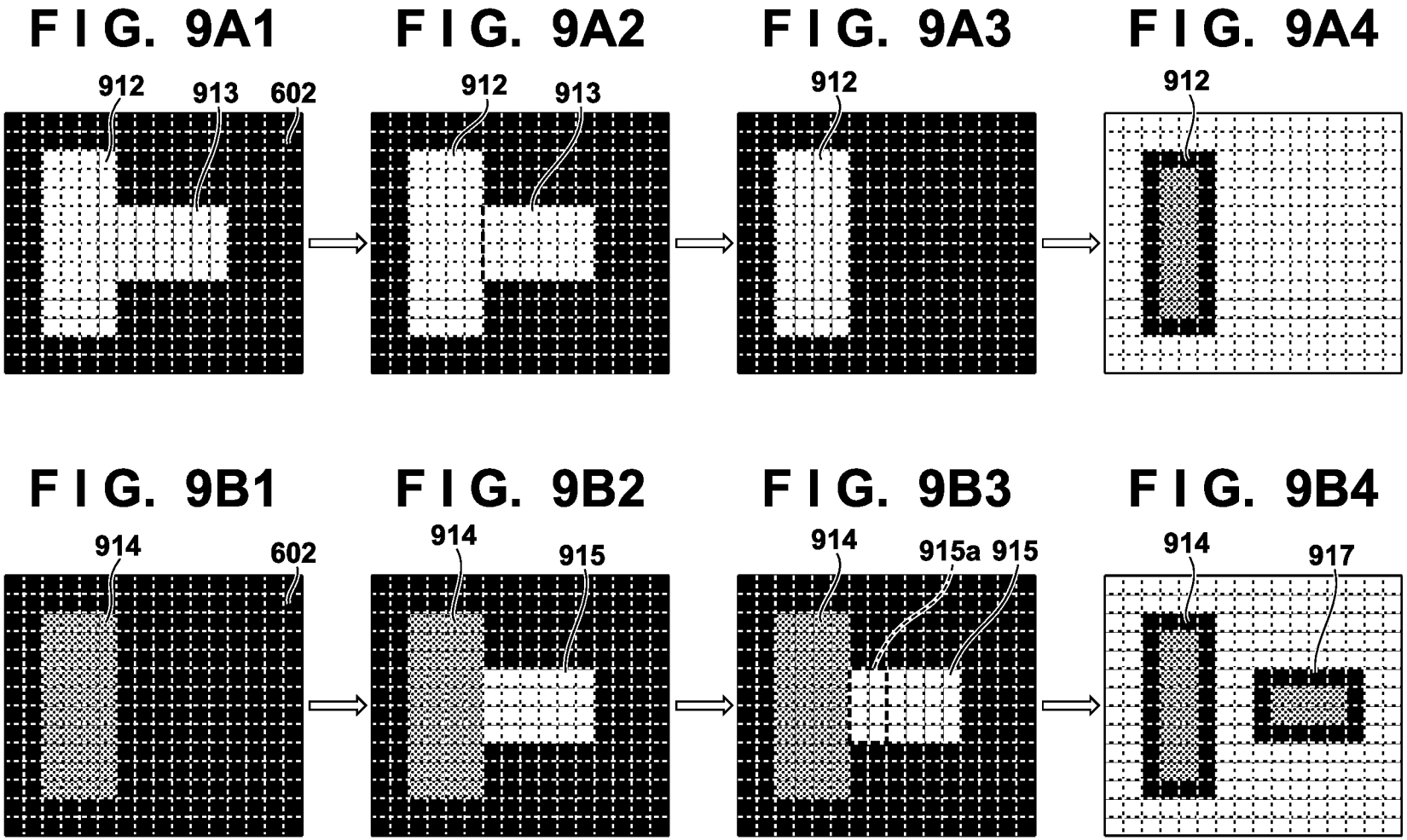
FIG. 9A1
912
913
602
FIG. 9A2
912
913
FIG. 9A3
912
FIG. 9A4
912
FIG. 9B1
914
602
FIG. 9B2
914
915
FIG. 9B3
914
915a
915
FIG. 9B4
914
917

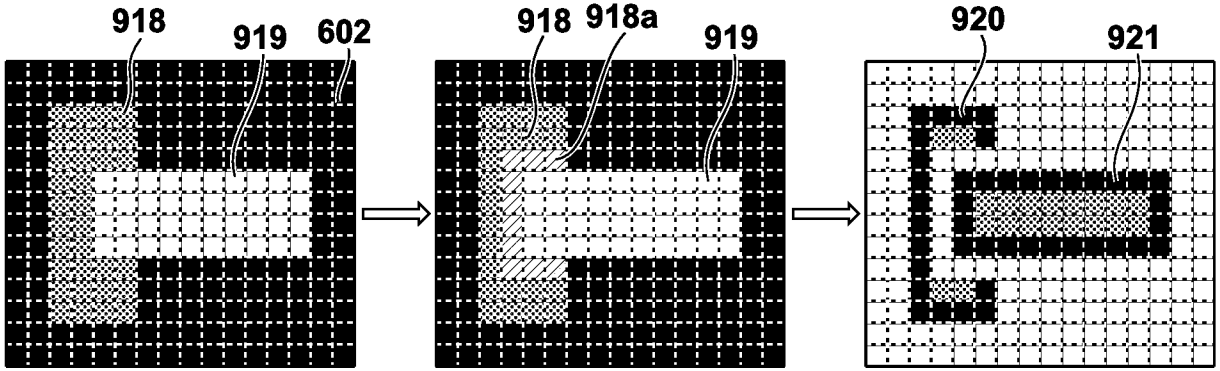
FIG. 9C1
FIG. 9C2
FIG. 9C3

IMAGE PROCESSING APPARATUS AND CONTROL METHOD

BACKGROUND OF THE INVENTION

Field of the Invention

The present invention relates to a system for forming an image and printing the image on a recording sheet.

Description of the Related Art

A thermal printer causes ink to sublimate from a solid to a gas and transfers the ink onto a recording sheet by pressing a heated thermal head against an ink ribbon. In the ink ribbon, sublimation dye layers of the colors yellow (Y), magenta (M), and cyan (C), and an overcoat (OC) layer are arranged. A printed medium with an excellently durable and water-resistant finish is generated by protecting a color image formed by the sublimation dye layers of the colors yellow (Y), magenta (M), and cyan (C) with a uniform high-gloss OC layer that is colorless and transparent.

Among thermal printers, a technique is known of forming a low-gloss line image on the overcoat surface by increasing the thermal energy during overcoat transfer (increasing gradation values in overcoat transfer data) and thereby roughening the overcoat surface contacting the ink ribbon. The low-gloss line image on the overcoat surface, which is formed on a high-gloss printed image, is difficult to see directly from the front due to the large amount of light reflected by the color image. However, when seen from a different angle, the line image on the overcoat surface becomes visible without the appearance of the color image being impaired thereby, due to a difference occurring in the amount of light reflected between high-gloss parts and low-gloss parts of the overcoat surface.

Japanese Patent Laid-Open No. 2013-111951 discloses a technique in which, in order to ensure visibility of a line image on the overcoat surface, the overcoat is not transferred onto an area of an image printed in color that is inside the outline of the line image.

In Japanese Patent Laid-Open No. 2013411951, a low-gloss overcoat and a high-gloss overcoat are formed on the image printed in color on the outline of the line image and on the area outside the outline, respectively, and no overcoat is transferred onto the area inside the outline, Thus, the image in the area inside the outline is not sufficiently protected by the overcoat surface, and appearance may be impaired. However, when a low-gloss overcoat surface is formed in the area inside the outline, the overcoat surface contacting the ink ribbon increases due to the roughening of the overcoat surface, resulting in a decrease in separability from the ink ribbon and the occurrence of overcoat separation failure. Furthermore, when a high-gloss overcoat surface has been formed in the area inside the outline, it is difficult to ensure visibility of the line image on the overcoat surface without impairing image appearance because visibility varied depending on the width of the outline area and visibility decreased when the outline area has been thin.

SUMMARY OF THE INVENTION

The present invention has been made in consideration of the aforementioned problems, and realizes a technique with which the visibility of a drawing part of an overcoat can be ensured without impairing image appearance.

In order to solve the aforementioned problems, the present invention provides an image processing apparatus that generates overcoat transfer data for transferring an overcoat, by a printing unit, onto an image formed on a recording sheet, the image processing apparatus comprising: a drawing unit configured to generate a line image to be added to the overcoat and an image processing unit configured to convert the line image into a drawing part to be added to the overcoat, and generate overcoat transfer data to be transferred onto the recording sheet by the printing unit, wherein the drawing part includes an outline part and an area inside the outline part, the outline part is formed from pixels having a first glossiness, the area inside the outline part is formed as a mixed pattern part in which pixels having the first glossiness and pixels having a second glossiness higher than the first glossiness are mixed, and the area outside the outline part is formed from pixels having the second glossiness.

In order to solve the aforementioned problems, the present invention provides a method of controlling an image processing apparatus that generates overcoat transfer data for transferring an overcoat onto an image formed on a recording sheet, the method comprising: generating a line image to be added to the overcoat and converting the line image into a drawing part to be added to the overcoat, and generating overcoat transfer data to be transferred onto a recording sheet by a printing apparatus, wherein the drawing part includes an outline part and an area inside the outline part, the outline part is formed from pixels having a first glossiness, and the area inside the outline part is formed as a mixed pattern part in which pixels having the first glossiness and pixels having a second glossiness higher than the first glossiness are mixed, and the area outside the outline part is firmed from pixels having the second glossiness.

In order to solve the aforementioned problems, the present invention provides a non-transitory computer-readable storage medium storing a program for causing a computer to function as each unit of an image processing apparatus that generates overcoat transfer data for transferring an overcoat, by a printing unit, onto an image formed on a recording sheet, the image processing apparatus comprising: a drawing unit configured to generate a line image to be added to the overcoat; and an image processing unit configured to convert the line image into a drawing part to be added to the overcoat, and generate overcoat transfer data to be transferred onto the recording sheet by the printing unit, wherein the drawing part includes an outline part and an area inside the outline part, the outline part is formed from pixels having a first glossiness, the area inside the outline part is formed as a mixed pattern part in which pixels having the first glossiness and pixels having a second glossiness higher than the first glossiness are mixed, and the area outside the outline part is formed from pixels having the second glossiness.

In order to solve the aforementioned problems, the present invention provides a non-transitory computer-readable storage medium storing a program for causing a computer to execute a method of controlling an image processing apparatus that generates overcoat transfer data for transferring an overcoat onto an image formed on a recording sheet, the method comprising: generating a line image to be added to the overcoat; and converting the line image into a drawing part to be added to the overcoat, and generating overcoat transfer data to be transferred onto a recording sheet by a printing apparatus, wherein the drawing part includes an outline part and an area inside the outline part, the outline part is formed from pixels having a first glossiness, and the area inside the outline part is formed as a mixed pattern part in which pixels having the first glossiness and pixels having a second glossiness higher than the first glossiness are mixed, and the area outside the outline part is formed from pixels having the second glossiness.

According to the present invention, the visibility of a drawing part of an overcoat can be ensured without impairing image appearance.

Further features of the present invention will become apparent from the following description of exemplary embodiments (with reference to the attached drawings).

BRIEF DESCRIPTION OF THE DRAWINGS

FIGS. 8A1, 8A2, 8A3, 8B1, 8B2, and 8B3 are diagrams for describing image conversion processing for adding a line image to the overcoat as a drawing part.

FIGS. 9A1, 9A2, 9A3, 9A4, 9B1, 9B2, 9B3, 9B4, 9C1, 9C2, and 9C3 are diagrams for describing the image conversion processing for adding a line image to the overcoat as a drawing part.

DESCRIPTION OF THE EMBODIMENTS

Figure 1A:
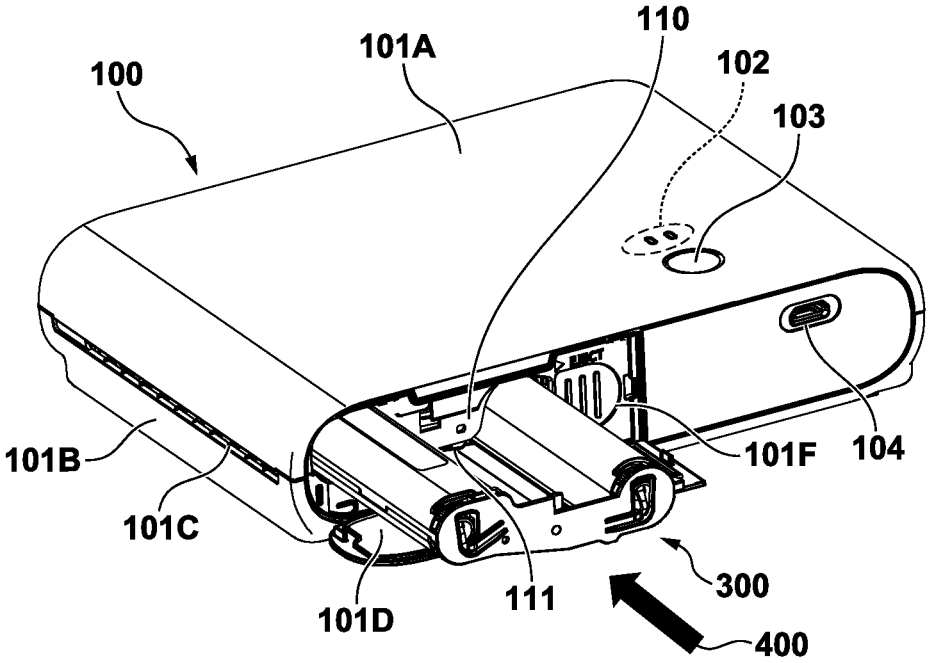
FIGS. 1A and 1B are perspective views illustrating the exterior configuration of a printer and an ink cassette according to the present embodiment.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

In the present embodiment, an example of a system in which an image processing apparatus and a printing apparatus (external printing apparatus) are connected by a wire or by a wireless connection so as to be capable of communicating with one another will be described. The image processing apparatus is a host device that has a drawing function for generating a line image to be added to the overcoat surface and an image processing function for converting the line image into a drawing part and generating overcoat data with the drawing part, and that outputs image data, print instructions including print setting information, etc., to the printing apparatus. For example, the host device is an information processing terminal such as a smart device, an information processing apparatus such as a personal computer, or an image-capturing apparatus such as a digital camera. The printing apparatus is a thermal-transfer-type or sublimation-type thermal printer. Note that the printing apparatus may include the drawing function and the image processing function described above, and in this case, overcoat data with the drawing part is generated by the printing apparatus rather than by the image processing apparatus.

Note that, while an example in which the printing apparatus is applied to a thermal-transfer-type or sublimation-type thermal printer will be described in the following, the present invention is not only applicable to a thermal printer but also is applicable to printers of other types as well.

Furthermore, the present invention is not limited to being applicable to a stand-alone printer, and is applicable to any apparatus having a printing function, such as a copier, a facsimile device, a computer system, or the like. Also, recording sheets according to the present invention include not only sheet materials made from paper materials but also sheet materials made from other materials, such as a plastic film or the like.

In a thermal printer, an ink ribbon (ink sheet) to which ink is applied and a recording sheet are pressed into contact with one another by a thermal head (print head) and a platen roller (receiving member), and printing is performed by conveying the ink ribbon and the recording sheet (print sheet) while in contact with the thermal head. A plurality of heating elements (resistance elements are arranged in line in the thermal head, and an image is formed on the recording sheet by selectively supplying electricity to these heating elements and thereby transferring the ink applied to the ink ribbon onto the recording sheet. Particularly, in full-color printing, a full-color image is formed by sequentially overlaying inks of the colors yellow (Y), magenta (M), and cyan (C) sequentially applied to the ink ribbon, and the transfer of an overcoat (OC) onto the image is also performed.

In the following description, "printing" refers to the overall series of operations from when an image is formed based on a print instruction from the image processing apparatus to when a recording sheet on which the image has been formed is discharged. Furthermore, "image forming" refers to operations that are included in the printing operations and that are for thermally transferring the overcoat and ink applied to the ink ribbon onto a recording sheet to form an image on the recording sheet and form an overcoat on the image. Note that, in the case of monochromatic printing, the recording sheet may be in the form of a roll and may be discharged by being cut into a predetermined size after an image is formed thereon.

<Configuration of Thermal Printer>

The overall configuration of a thermal printer (hereinafter "printer") according to the present embodiment will be described with reference to FIGS. 1A and 1B.

Figure 1B:
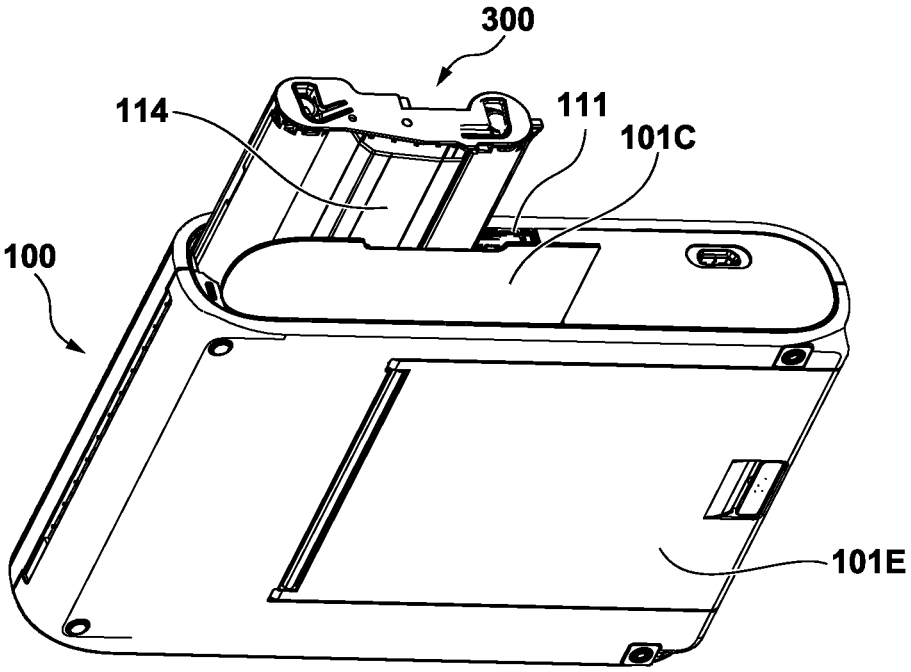

FIG. 1A is a perspective view illustrating the exterior configuration of a printer 100 and an ink cassette 300 according to the present embodiment, as seen from above. FIG. 1B is a perspective view illustrating the exterior configuration of the printer 100 and the ink cassette 300 according to the present embodiment, as seen from below.

The printer 100 includes an upper case 101A and a lower case 101B as exterior members covering the upper and lower sides of the printer main body. As a discharge port 101C, a slit-shaped gap that forms an opening that serves as the discharge port 1010 is formed between mating surfaces of the upper case 101A and the lower case 101B on one side surface of the printer 100. A recording sheet 113 may temporarily protrude to the outside of the printer 100 from the discharge port 1010 during printing, or a recording sheet 113 on which an image has been formed may be discharged from the discharge port 1010. Note that recording sheets 113 are not illustrated in FIGS. 1A and 1B.

Furthermore, on another side surface of the printer 100, a cassette cover 1011) is provided so as to be openable/closable. The cassette cover 101D can open and close a cassette mounting portion 111 that is an opening provided in a. Chassis 110. An ink cassette 300 can be inserted to and removed from the printer 100 via, the cassette mounting portion 111. When the cassette cover 1011) is open, the ink cassette 300 can be mounted to the cassette mounting portion 111 inside the printer 100 via the cassette mounting portion 111 in a mounting direction indicated h an arrow 400 and can be removed to the exterior of the printer 100 in an opposite direction to the direction of the arrow 400. A cassette lever 101F holds the ink cassette 300 inside the printer 100, and is operated to remove the ink cassette 300 from the printer 100.

A long ink ribbon 114 is housed inside the ink cassette 300, and the ink ribbon 114 is convened during image forming by motive power applied thereto from the printer 100. The ink cassette 300 will be described in detail later.

A tray cover 101E is provided so as to be openable/closable on the bottom surface of the printer 100, and a prescribed number of recording sheets 113 can be loaded to a later-described sheet storage portion 117 by opening the tray cover 101E. Recording sheets 113 of a prescribed size are set by a user to the sheet storage portion 117, and during printing, only one recording sheet 113 is drawn out from the sheet storage portion 117 by an unillustrated paper feeding mechanism of the printer 100. A full color image is formed on the recording sheet 113 by an overcoat and inks of the colors yellow (Y), magenta (M), and cyan (C) that are applied to the ink ribbon 114, which will be described later with reference to FIGS. 3A and 3B, being transferred onto the recording sheet 113 by a thermal head 116.

On the upper surface of the upper case 101A, a display unit 102 and an operation unit 103 are provided. Furthermore, an external connection terminal 104 is provided on a side surface of the printer 100, and the printer 100 can be connected with the host device via a wire such as a USB cable. Furthermore, a wireless communication module is provided inside the printer 100, and the printer 100 can be wirelessly connected with the host device via a wireless LAN or the like. The printer 100 can perform printing operations by receiving image data from the host device connected therewith via the external connection terminal 104 or the wireless communication module.

The display unit 102 includes a plurality of light-emitting elements such as LEDs, and indicates the operation state of the printer 100 by the color of light emitted, by emitting light, by flashing, or the like. The operation unit 103 accepts operation instructions such as the turning on/off of the printer 100. When the printer 100 receives image data and a print instruction including print setting information from the host device while the printer 100 is on, the printer 100 starts the printing operations in accordance with the print instruction.

Figure 2:
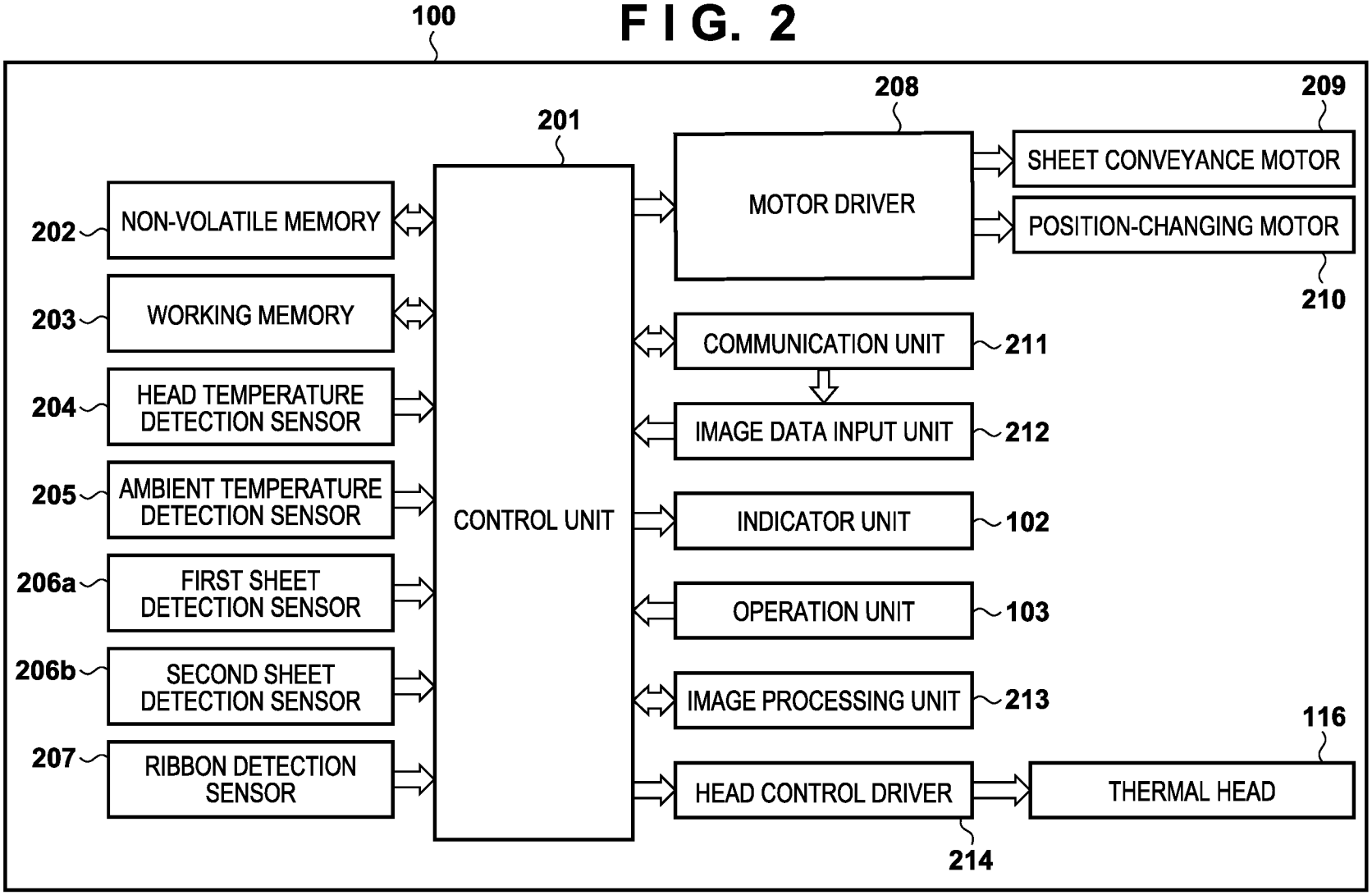
FIG. 2 is a block diagram illustrating the internal configuration of the printer according to the present embodiment.

Next, the internal configuration of the printer 100 according to the present embodiment will be described with reference to FIG. 2. FIG. 2 is a block diagram illustrating the internal configuration of the printer 100 according to the present embodiment.

A control unit 201 is a controller that includes an interface circuitry for transmitting and receiving data to and from the later-described components of the printer 100, and a CPU or MPU for performing computational processing for controlling the operations of the entire printer 100.

A non-volatile memory 202 is an electrically erasable and recordable memory, and a flash ROM or the like is used as the non-volatile memory 202, for example. The non-volatile memory 202 stores a control program for the printer 100, and the control unit 201 reads the program from the non-volatile memory 202 and controls the components of the printer 100 based on the read program.

A volatile memory such as a RAM is used as a working memory 203, and the working memory 203 is used as a work area in which constants and variables for the operation of the control unit 201, the program read from the non-volatile memory 202, etc., are decompressed. Furthermore, the working memory 203 temporarily stores image transfer data, overcoat transfer data, print instructions including print setting information, etc., that are received from the host device 600 via a communication unit 211.

A head temperature detection sensor 204 detects the temperature of the thermal head 116, and outputs the detection result to the control unit 201. An ambient temperature detection sensor 205 detects the temperature inside the printer 100, and outputs the detection result to the control unit 201. The control unit 201 performs various types of temperature control, such as temperature correction of the thermal head 116 and a wait operation, based on the detection results of the head temperature detection sensor 204 and the ambient temperature detection sensor 205. Furthermore, the printer 100 includes a first sheet detection sensor 206*a* for detecting feeding of a recording sheet 113 and a second sheet detection sensor 206*b* for detecting discharge of a recording sheet 113 and can control the positions of sheets accurately. Also, the printer 100 includes a ribbon detection sensor 207 for detecting markers 114*a* for controlling the position of the ink ribbon 114. The control unit 201, by executing the program based on the information detected by the sensors, outputs commands to a motor driver 208 to drive and control a sheet conveyance motor 209 and a position-changing motor 210.

The sheet conveyance motor 209 drives and conveys recording sheets 113 and the ink ribbon 114. The position-changing motor 210 drives lifting and switching mechanism so as to move the thermal head 116 to a pressing position or a retracted position and to move a sheet-feeding roller 121 up and down. The communication unit 211 connects to the host device so as to be capable of communicating with the host device, and can receive image data and print instructions including print setting information and can transmit and receive various types of data. An image data input unit 212 receives, from the communication unit 211, the image data received from the host device, and outputs the image data to the control unit 201. The control unit 201 outputs the image data received from the host device to an image processing unit 215.

The display unit 102 indicates the operation state of the printer 100 by the color of light emitted by the LEDs, by the flashing of the LEDs, by the LEDs emitting light, or the like. The operation unit 103 is an operation member, such as a power switch, for accepting operation instructions made by the user to the printer 100. Furthermore, the communication unit 211 notifies the control unit 201 of print instructions received from the host device. The image processing unit 215 performs various types of image processing on image data received by the image data input unit 212. The image processing unit 215 performs various types of image processing, such as processing for decoding the image data, processing for resizing the image data in accordance with a recording sheet, and processing for image correction of the image data, and generates printing data for forming an image from the image data having been subjected to image processing.

A head control driver 216 controls the thermal head 116. Printing data generated by the image processing unit 215 is output to the head control driver 216. The printing data input to the head control driver 216 is converted into electric signals, which are output to the thermal-head heating elements. The heating elements convert the electric signals into thermal energy, causing ink applied to the ink ribbon 114 to be transferred onto a recording sheet 113.

Next, the configurations of a recording sheet 113 and the ink ribbon 114 will be described with reference to FIGS. 3A and 3B.

Figure 3A:
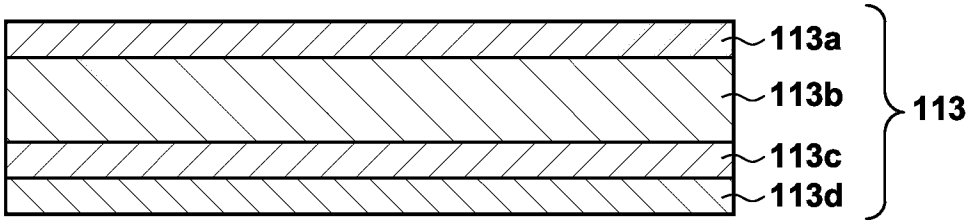
FIGS. 3A and 3B are each a cross-sectional view of a recording sheet according to the present embodiment and an expanded view of an ink ribbon according to the present embodiment.

FIG. 3A is a cross-sectional view of a recording sheet according to the present embodiment. The recording sheet 113 has a four-layer structure including an image-receiving layer 113*a*, a base-material layer 113*b*, an adhesive layer 113*c*, and a peeling layer 113*d*. The overcoat (OC) and the inks of the colors yellow (Y), magenta (M), and cyan (C) are transferred onto the image-receiving layer 113*a*. The image-receiving layer 113*a* and the adhesive layer 113*c* are applied to the base-material layer 113*b*. The adhesive layer 113*c* imparts, to the recording-sheet rear surface, tackiness allowing the rear surface to be adhered. The peeling layer 113*d* covers the adhesive layer 113*c* to prevent unintended adhesion of the adhesive layer 113*c*.

Figure 3B:
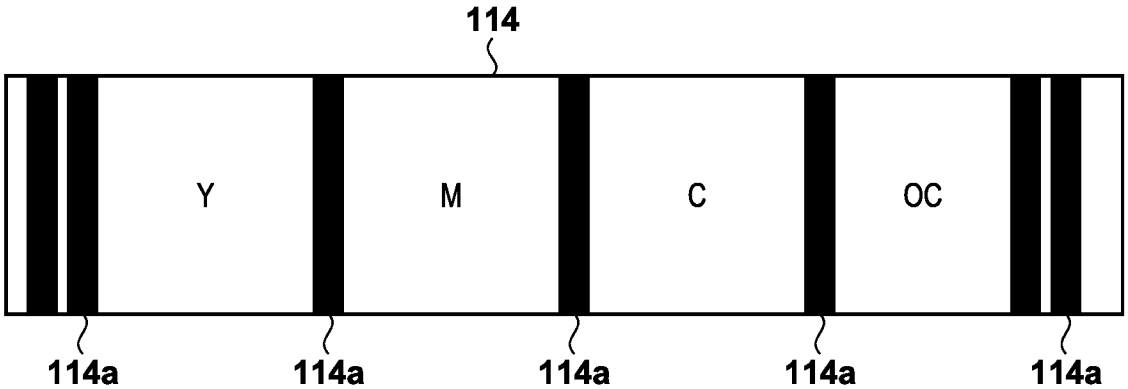

FIG. 3B is an expanded view of the ink ribbon 114 according to the present embodiment. In the case of full-color printing, inks of the colors yellow (Y), magenta (M), and cyan (C) are arranged on the ink ribbon 114. Furthermore, a full-color image is formed by performing image forming in a state in which each ink color is overlaid on a recording sheet 113, and an overcoat (OC) surface is further formed on the image. Black band-shaped markers 114*a* for detecting the beginning position of the ink of each color are arranged between the inks of the different colors, and two markers 114*a* indicating the beginning of the yellow (Y) surface are arranged in order to distinguish yellow from the other colors. In the ink ribbon according to the present embodiment, a highly heat-resistant film such as a polyethylene terephthalate film having a thickness of around two microns to ten and a few microns is used as a base material. As the inks of the colors yellow (Y), magenta (M), and cyan (C), sublimation inks prepared by mixing dyes, binders, plasticizers, binding agents, etc., are applied onto the film to a thickness of around 0.2 to 5 μm. The transparent and colorless overcoat surface is formed by applying a styrose derivative, a styrene resin, a styrene copolymer resin, a binder, etc., to a thickness of around 0.5 to 5 μm. Furthermore, on the surface on the opposite side from the surface onto which the inks are applied, a lubricant for reducing frictional resistance between the ink ribbon and the thermal head and stabilizing the travel of the ink ribbon, a polishing agent for polishing and cleaning the thermal-head surface, etc., are applied.

Next, the operation procedures of the printer 100 according to the present embodiment during printing will be described with reference to FIGS. 4A to 4F and FIGS. 5A and 5B.

Figure 4A:
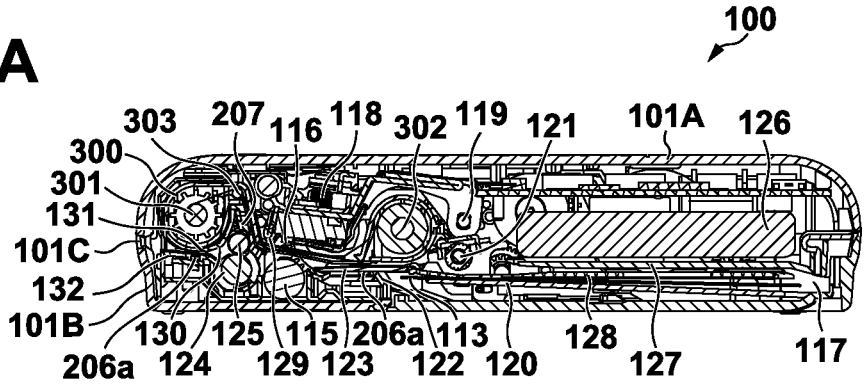
FIGS. 4A to 4F are lateral cross-sectional views for describing operations of the printer according to the present embodiment during printing.
Figure 4B:
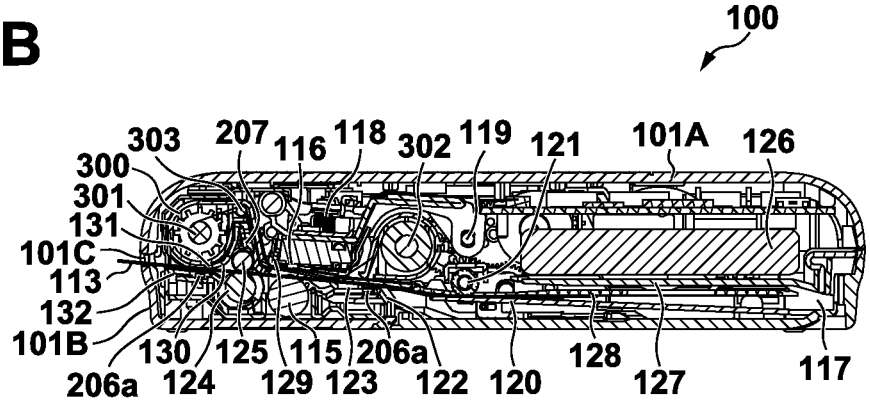
Figure 4C:
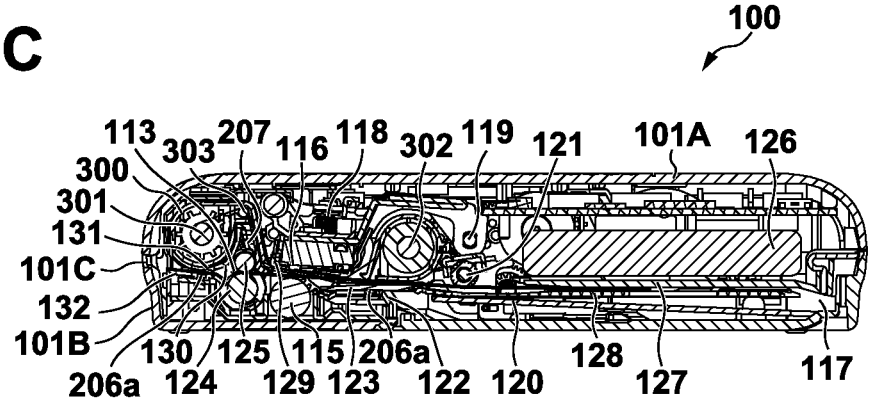
Figure 4D:
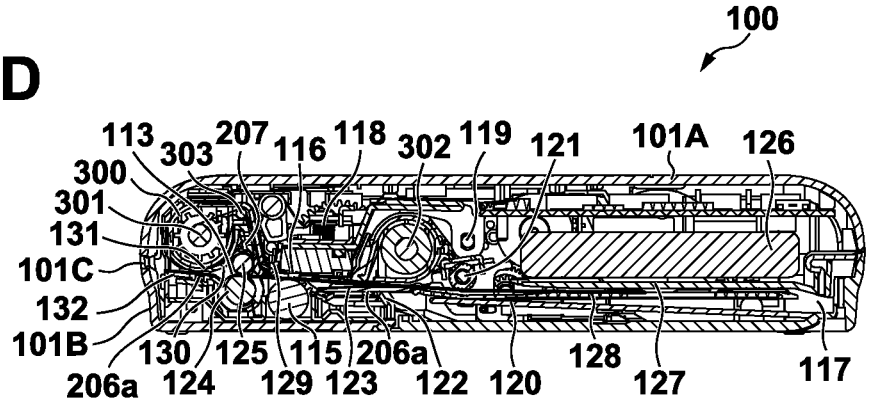
Figure 4E:
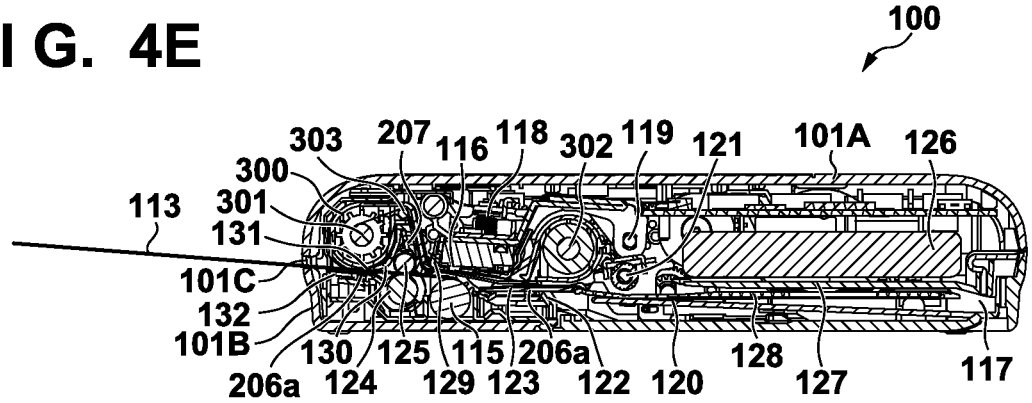
Figure 4F:
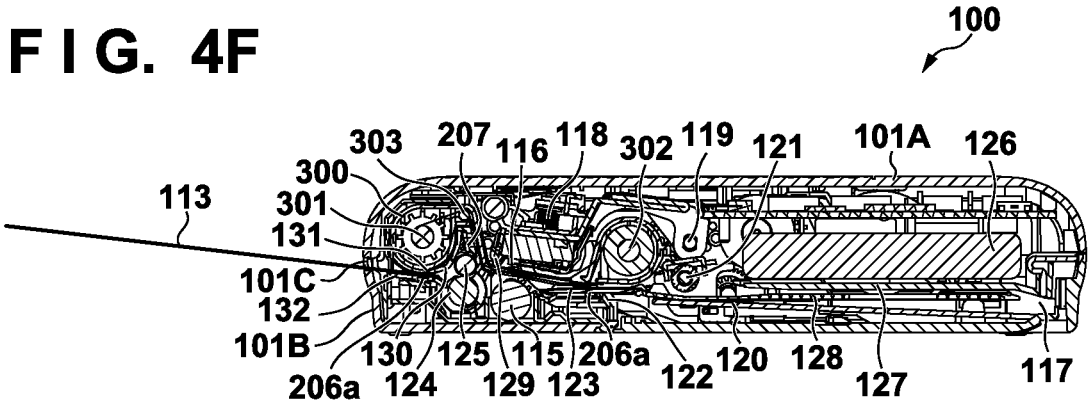
Figure 5A:
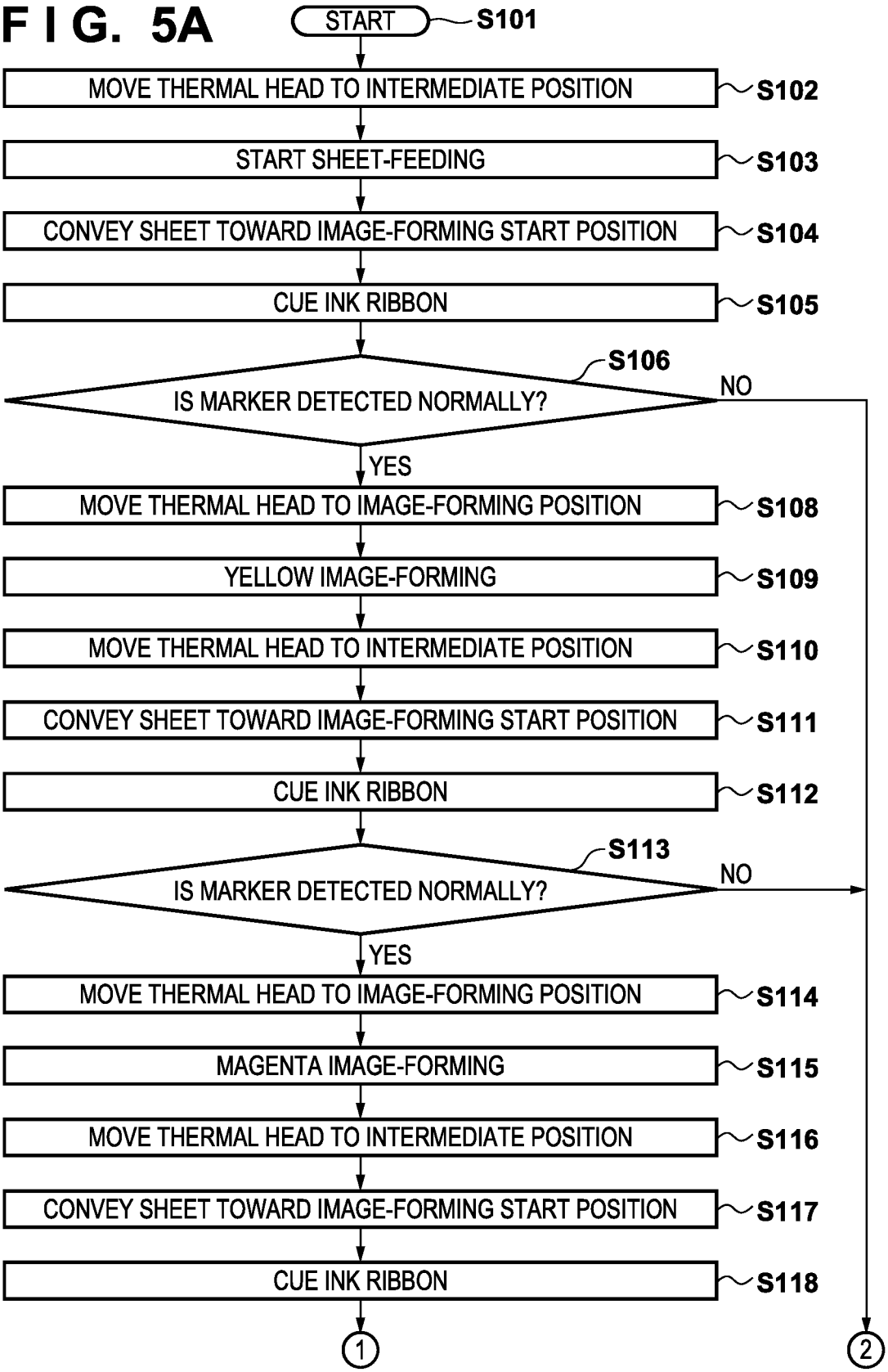
FIGS. 5A and 5B are flowcharts illustrating processing procedures of the printer according to the present embodiment during printing.
Figure 5B:
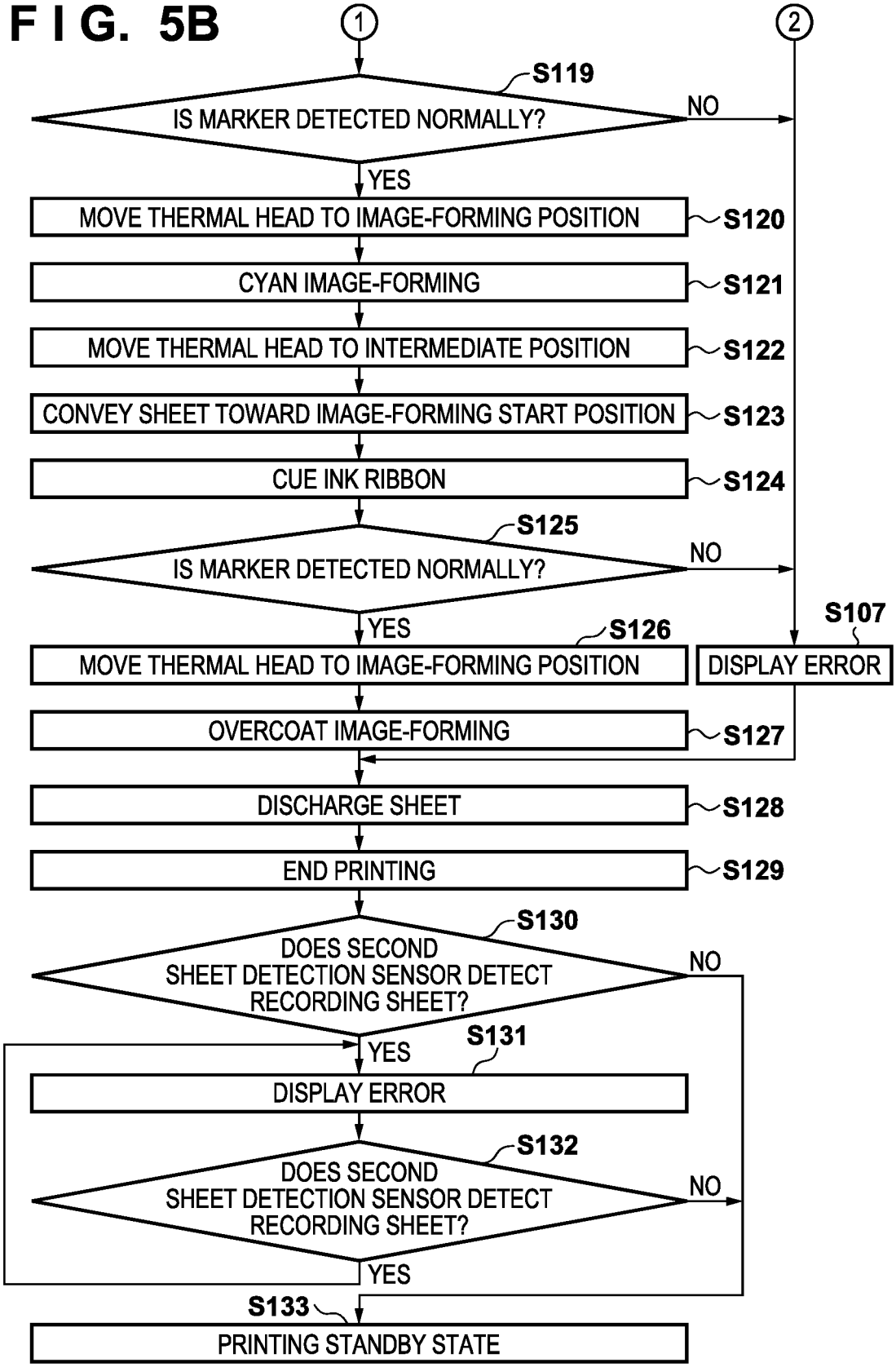

FIGS. 4A to 4F are lateral cross-sectional views for describing the operations of the printer 100 according to the present embodiment during printing, with FIG. 4A illustrating a standby state, FIG. 4B illustrating a sheet-feeding state, FIG. 4C illustrating a state when image forming is started, FIG. 4D illustrating a state during image forming, FIG. 4E illustrating a state after the completion of image forming and before a sheet discharge operation, and FIG. 4F illustrating a state after the sheet discharge operation. FIGS. 5A and 5B are flowcharts illustrating operation procedures of the printer 100 according to the present embodiment during printing.

When the user sets the ink cassette 300 inside the printer 100, places recording sheets 113 in the sheet storage portion 117, and turns on the printer 100 using the operation unit 103, the printer 100 enters a standby state. When the reception of image data from the host device is started in the standby state, the LEDs of the display unit 102 flash to provide a notification of a data loading state. The printer 100 includes a platen roller 115 and the thermal head 116. The thermal head 116 is rotatably supported by a thermal-head supporting shaft 119, and is biased in the clockwise direction in the drawings by a coil spring 118. In order to prevent the thermal head 116 from interfering with the ink cassette 300 during mounting of the ink cassette 300, the position of the thermal head 116 is restricted to a position where the distance from the platen roller 115 is maximized.

Next, when image data to be printed is designated on the host device and a print instruction is made, the printer 100 receives the print instruction from the host device and starts the printing operations (step S101). When the printing operations are started, the primer 100, by using the driving force of the unillustrated position-changing motor 210, rotates the thermal head 116 in the counterclockwise direction in the drawings about the thermal-head supporting shaft 119 against the biasing force of the coil spring 118. As illustrated in FIG. 4B, the thermal head 116 moves to an intermediate position midway between the standby position in FIG. 4A and an image-forming position in FIG. 4D, where the thermal head 116 forms a nip with the platen roller 115 (step S102). When the thermal head 116 finishes moving, the printer 100 starts sheet-feeding operations (step S103). When the sheet-feeding operations are started, a pressing plate 120 provided in the printer 100 is biased toward the sheet-feeding roller 121-side by an unillustrated biasing technique, and pushes the recording sheets 113 stacked in the sheet storage portion 117 upward against the sheet-feeding roller 121. In the standby position in FIG. 4A, the sheet-feeding roller 121 is retracted to a distance from the recording sheets 113. In the intermediate position in FIG. 4B, the sheet-feeding roller 121 is pushed down by the driving force of the unillustrated position-changing motor 210 to a position where the sheet-feeding roller 121 comes into contact with the recording sheets 113. At this time, the sheet-feeding roller 121 rotates in the counterclockwise direction in the drawings due to the driving force of the unillustrated sheet conveyance motor 209 and conveys the recording sheets 113 toward an image-forming unit including the thermal head 116 and the platen roller 115. The recording sheets 113 come in contact with a separating portion 122 of the printer 100, and thus only one recording sheet 113 at the top of the stack is conveyed. The conveyed recording sheet 113 is detected by the first sheet detection sensor 206*a*, and it is confirmed that there are no problems with the sheet feed operations. Subsequently, the recording sheet 113 conveyed by the sheet-feeding roller 121 causes a rotatably-supported changeover plate 123 to rotate in the clockwise direction in the drawings by pushing the changeover plate 123 upward, advances toward the left direction in the drawings, and enters a nip area between a conveyance roller 124 and a conveyance slave roller 125. A plurality of minute protrusions that come into contact with the rear surface of the recording sheet 113 are formed on the conveyance roller 124, and the minute protrusions come into contact with the recording sheet 113, allowing the recording sheet 113 to be conveyed accurately. The conveyance roller 124 is driven by the unillustrated sheet conveyance motor 209. The sheet conveyance motor 209 is a stepping motor, allowing the feed rate to be controlled accurately. By the second sheet detection sensor 206*b* detecting the recording sheet 113, it is confirmed whether the recording sheet 113 is being properly conveyed to the nip area between the conveyance roller 124 and the conveyance slave roller 125. After the recording sheet 113 is conveyed to the nip area between the conveyance roller 124 and the conveyance slave roller 125, the sheet-feeding roller 121 moves to the standby position illustrated in FIG. 4A due to the driving force of the position-changing motor 210. This is done in order to prevent the next recording sheet 113 in the sheet storage portion 117 from being erroneously conveyed by the sheet-feeding roller 121. The conveyance of the recording sheet 113 is continued by the conveyance roller 124 and the conveyance slave roller 125, and is stopped once the rear end portion of the recording sheet 113 passes the front end portion of the changeover plate 123 after passing the first sheet detection sensor 206*a* and being conveyed by a predetermined amount. Next, the printer 100 conveys the recording sheet 113 backward toward the opposite direction, and stops at the image-forming start position illustrated in FIG. 4C (step S104). At this time, the rear end portion of the recording sheet 113 passes over the changeover plate 123 and beneath the sheet-feeding roller 121, and is conveyed to the space between a sheet storage portion wall 128 and a guide wall 127 partitioning off the lower part of a battery 126 and holding the battery 126. The sheet storage portion wall 128 limits the number of recording sheets 113 that can be loaded in the sheet storage portion 117.

Once the sheet-feeding operations finish and the recording sheet 113 has stopped at the image-forming start position, cueing operations for the yellow (Y) surface of the ink ribbon 114 are performed (step S105). The ribbon cueing operations will be described below. Once the recording sheet 113 has been conveyed to the image-forming start position illustrated in FIG. 4C, the ink ribbon 114 housed in the ink cassette 300 is drawn out. Specifically, an end portion of a winding shaft 301 of the ink cassette 300 engages with an engagement portion of the printer 100 and is rotated in the counterclockwise direction in the drawings by an unillustrated drive mechanism, causing the ink ribbon 114 wound around a supply shaft 302 to be drawn out and wound around the winding shaft 301. As illustrated in FIGS. 3A and 3B, a marker 114*a* is provided at the beginning of the ink of each color on the ink ribbon 114, and two markers 114*a* are provided at the beginning of the yellow (Y) surface. When a ribbon detection sensor 207, which is a reflection-type optical sensor, detects the blocking of reflection light by a marker 114*a* provided on the ink ribbon 114, the printer 100 stops winding the ink ribbon 114 to perform cueing. The cueing of the yellow (Y) surface is determined in accordance with whether or not two markers 114*a* have been detected (step S106). If only one marker 114*a* is detected or no markers 114*a* are detected within a predetermined amount of time during the cueing of the yellow (Y) surface, it is regarded that an abnormality has occurred in the ink cassette 300 and a state indicating an error is indicated by the display unit 102 (step S107). Subsequently, the thermal head 116 is moved to the standby position illustrated in FIG. 4A, and the printing operations are terminated (step S129).

Once the cueing of the yellow (Y) surface finishes, the thermal head 116 rotates further in the counterclockwise direction in the drawings about the thermal-head supporting shaft 119 and moves to the image-forming position, in which the thermal head 116 sandwiches the ink ribbon 114 and the recording sheet 113 between the platen roller 115 and itself (step S108). Once the thermal head. 116 moves to the image-forming position, the recording sheet 113 and the ink ribbon 114, which are still sandwiched between the thermal head 116 and the platen roller 115 as illustrated in FIG. 4D, are heated by the thermal head 116 while being conveyed toward the discharge port 1010, and ink applied to the ink ribbon 114 is transferred onto the recording sheet 113 to perform image forming (step S109). Since the ink ribbon 114 and the recording sheet 113 are conveyed at the same speed during image forming, an ink ribbon conveyance mechanism of the printer 100 has incorporated therein a later-described torque limiter that slips when a load of a predetermined torque or more is applied.

When the ink ribbon 114 and the recording sheet 113 are subjected to image forming by being heated by the thermal head 116, the ink ribbon 114 and the recording sheet 113 are conveyed for a predetermined distance while being kept in a state of close contact with one another before being conveyed in directions away from one another. Specifically, the recording sheet 113 is conveyed in the left direction in the drawings by the conveyance roller 124, and the ink ribbon 114 is conveyed toward a guide shall 303 of the ink cassette 300 while sliding on a separation plate 129 of the thermal head 116. The ink ribbon 114 adheres to the recording sheet 113 due to being heated by the thermal head 116 during image forming, but is stripped away from the recording sheet 113 after being conveyed to the position of the separation plate 129. Once image forming on yellow image areas of the recording sheet 113 is finished, the unillustrated drive mechanism of the printer 100 rotates the thermal head 116 and causes the thermal head 116 to be retracted to the position illustrated in FIG. 4E (step S110). Subsequently, the recording sheet 113 is conveyed in the direction opposite from that during the image-forming operations to the position illustrated in FIG. 4C to be moved to the image-forming start position (step S111). Following this, in a similar manner as in the yellow (Y) image-forming operations, the ink ribbon 114 is wound and conveyed to the image-forming start position and stopped by detecting a marker 114*a* to form a magenta (M) image (steps S112 to S115). Cyan (C) and overcoat (OC) images are formed by detecting markers 114*a* and performing cueing in a similar manner (steps S116 to S127). Once the forming of the overcoat image is finished, the recording sheet 113 is conveyed toward the discharge port 101C after the thermal head 116 is retracted from the recording sheet 113 as illustrated in FIG. 4E, and sheet discharge is finished once the rear end portion of the recording sheet 113 passes the conveyance roller 124 (step S128). As illustrated in FIG. 4F, once the sheet discharge operation is finished, the thermal head 116 is rotated to the standby position illustrated in FIG. 4A by the unillustrated drive mechanism and the printing operations are terminated (step S129).

Through such procedures, the image-forming operations in which inks are overlaid and transferred onto the recording sheet 113 in the order of yellow (Y), magenta (M), cyan (C), and the overcoat (OC) are completed.

The printer 100 according to the present embodiment performs the sheet discharge operation in a manner such that the recording sheet 113 is not completely discharged to the outside of the apparatus in the state after the sheet discharge operation illustrated in FIG. 4F. In other words, the rear end portion of the recording sheet 113 remains inside the printer 100 in the state after the sheet discharge operation illustrated in FIG. 4F, The printer 100 is a small mobile printer having high portability, and is not provided with a member on which printed recording sheets 113 are to be stacked. Furthermore, a case of use in which the user performs image forming while holding the mobile printer in the user's hand(s) can also be expected, and in such a case, a printed recording sheet 113 may fall from the printer 100. In view of this, in the printer 100 according to the present embodiment, a printed recording sheet 113 is prevented from falling accidentally by fixing a sheet pressing plate 131 to a downstream upper sheet guide member 130 located downstream of the conveyance roller 124 and pressing the printed recording sheet 113 against a downstream lower sheet guide member 132 by a light force. The printed recording sheet 113 needs to be removed by the user in order to place the printer 100 in a state in which subsequent printing can be performed. If the recording sheet 113 is detected by the second sheet detection sensor 206*b* (step S130) and the rear end portion of the recording sheet 113 is still inside the printer 100, an indication of an error is provided on the display unit 102 so as to urge the user to remove the recording sheet 113 (step S131). Following this, the detection of the recording sheet 113 by the second sheet detection sensor 206*b* is continued (step S132), and the printer 100 transitions to the standby state illustrated in FIG. 4A and subsequent printing can be performed once the recording sheet 113 having been subjected to the image-forming operations is removed (step S133).

The series of printing operations is terminated through the above-described procedures.

<Configuration of Host Device>

The overall configuration of the host device according to the present embodiment will be described with reference to FIG. 6.

Figure 6:
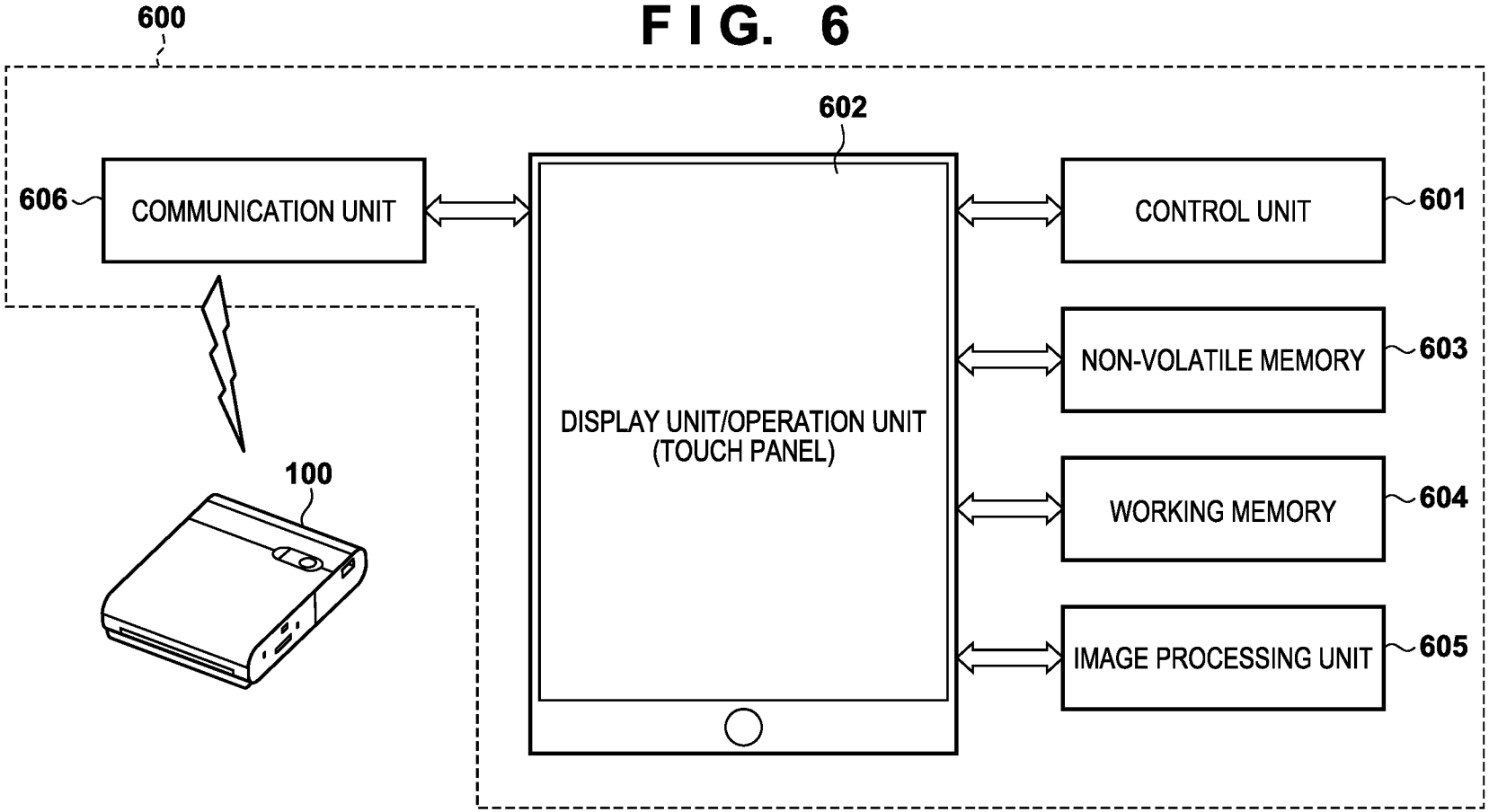
FIG. 6 is a block diagram illustrating the internal configuration of a host device according to the present embodiment.

FIG. 6 is a block diagram illustrating the configuration of the host device 600. The host device 600 includes a control unit 601, a display unit/operation unit 602, a non-volatile memory 603, a working memory 604, an image processing unit 605, and a communication unit 606.

A control unit 601 is a controller that includes an interface circuitry for transmitting and receiving data to and from the later-described components of the host device 600, and a CPU or MPU for performing computational processing for controlling the operations of the entire host device 600. The control unit 601 controls the components of the host device 600 by reading and executing programs stored in the later-described non-volatile memory 603.

The display unit/operation unit 602 is formed from a display device such as a liquid-crystal panel or an organic EL panel. The display unit/operation unit 602 displays a home screen, webpages, a menu screen, print-target image data, a handwriting screen, etc. Furthermore, the display unit/operation unit 602 includes a touch panel (touch screen) that is formed integrally with a display screen and that can detect touch operations performed on the display screen.

The control unit 601 can detect the following operations or states on the touch panel.

Touch-down: A newly performed touch on the touch panel by a finger or stylus that has not been touching the touch panel.

Touch-on: A state in which the touch panel is being touched with a finger or stylus.

Touch-move: The movement of a finger or stylus while touching the touch panel with the finger or stylus.

Touch-up: The release of a finger or stylus that has been touching the touch panel (end of touch).

Touch-off: A state in which nothing is touching the touch panel.

Furthermore, by an application or the like operating on the host device 600 associating input coordinates on the touch panel and display coordinates on the display screen with one another, a GUI can be configured as if the user can directly operate the display screen. Note that the touch panel may be a device that can acquire contact strength (pressing force).

The user can use an editor software program to draw line images such as characters and drawings on the overcoat surface using the user's finger(s) or a stylus on the touch panel.

Anon-volatile memory 603 is an electrically erasable and recordable memory, and a flash ROM or the like is used as the non-volatile memory 603, for example. Programs, constants, etc., for the operation of the control unit 601 are stored in the non-volatile memory 603. The programs as referred to here are programs for executing the later-described flowchart, and include a printer-control software program for controlling the printer 100 and the editor software program for drawing line images on the overcoat surface.

A volatile memory such as a RAM is used as the working memory 604, and the working memory 604 is used as a work area in which constants and variables for the operation of the control unit 601, the programs read from the non-volatile memory 603, etc., are decompressed. Furthermore, the working memory 604 temporarily stores image transfer data, overcoat transfer data, print instructions including print setting information, etc., that are to be transmitted to the printer 100 via the communication unit 606.

The image processing unit 605 performs: processing for generating image transfer data by performing various types of image processing, such as color conversion processing, pixel correction processing, and filter processing on image data; processing for converting line images created by the user using the editor software program into drawing parts to be added to the overcoat; and processing for converting overcoat data to which drawing parts have been added into overcoat transfer data for the printer 100.

The communication unit 606 is an interface that connects to the printer 100 via a wired or wireless system so as to be capable of communicating with the printer 100, and transmits image data to be printed and print instructions to the printer 100 and receives information regarding operation state from the printer 100.

<Description of Image, Conversion Processing>

Next, image conversion processing according to the present embodiment for adding a line image to the overcoat as a drawing part will be described with reference to FIG. 7A to FIG. 10B.

Figures 7A, 7B, 7C:
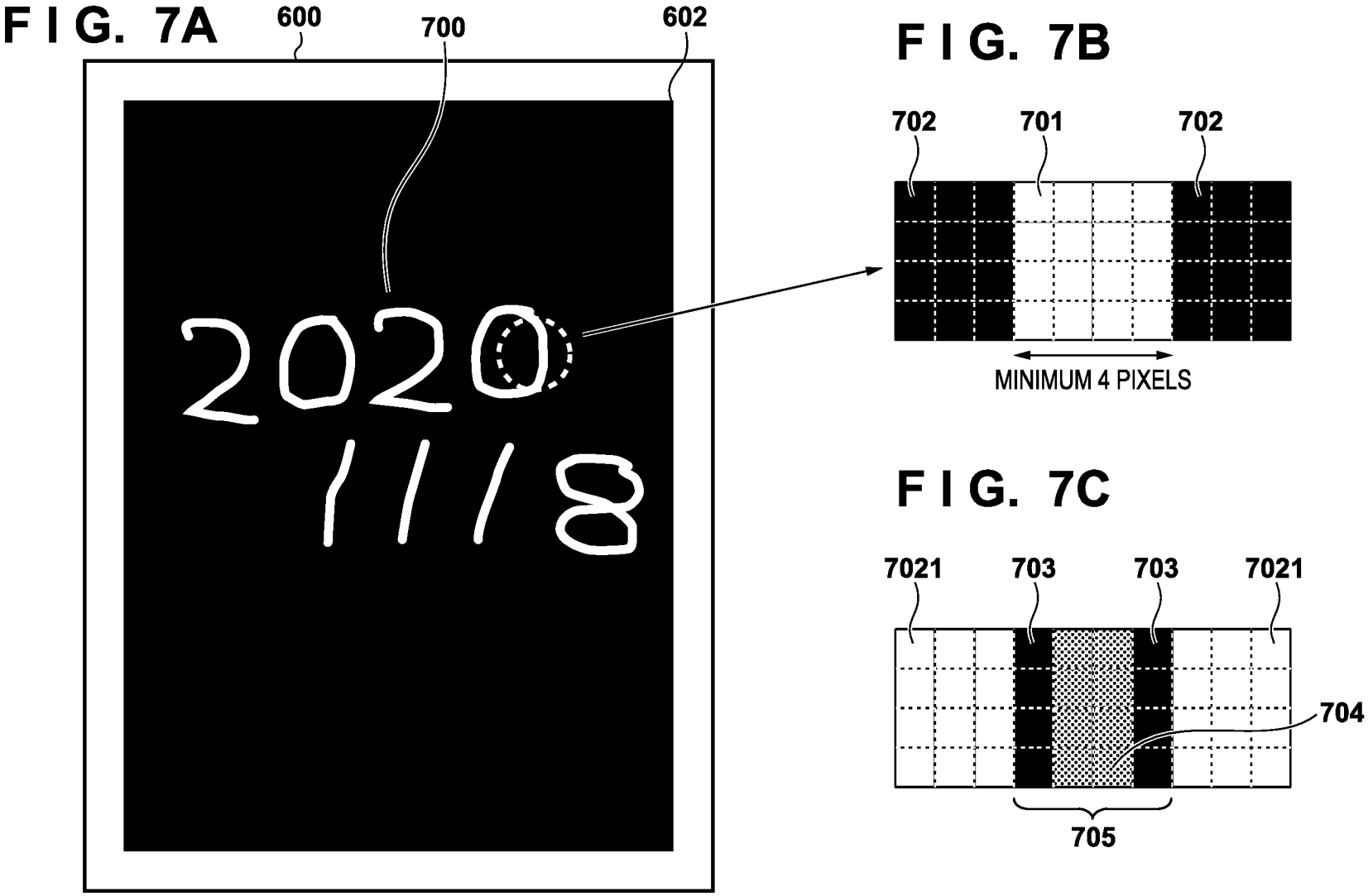
FIG. 7A is a diagram illustrating an example of a line image drawn on an overcoat.
FIGS. 7B and 7C are diagrams in which a part of the line image drawn on the overcoat is enlarged.
Figure 10A:
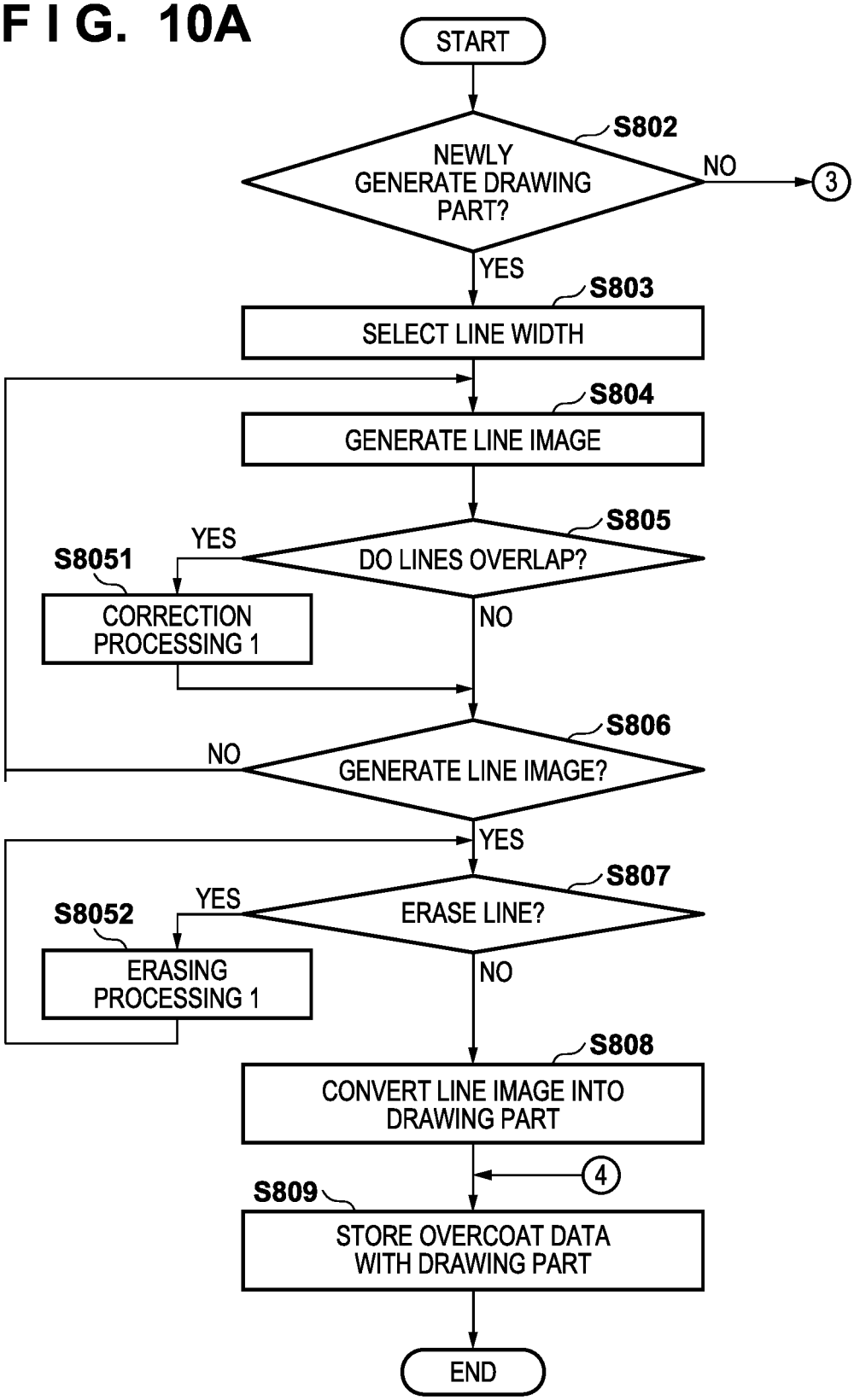
FIGS. 10A and 10B are flowcharts illustrating procedures of the image conversion processing for adding a line image to the overcoat as a drawing part.
Figure 10B:
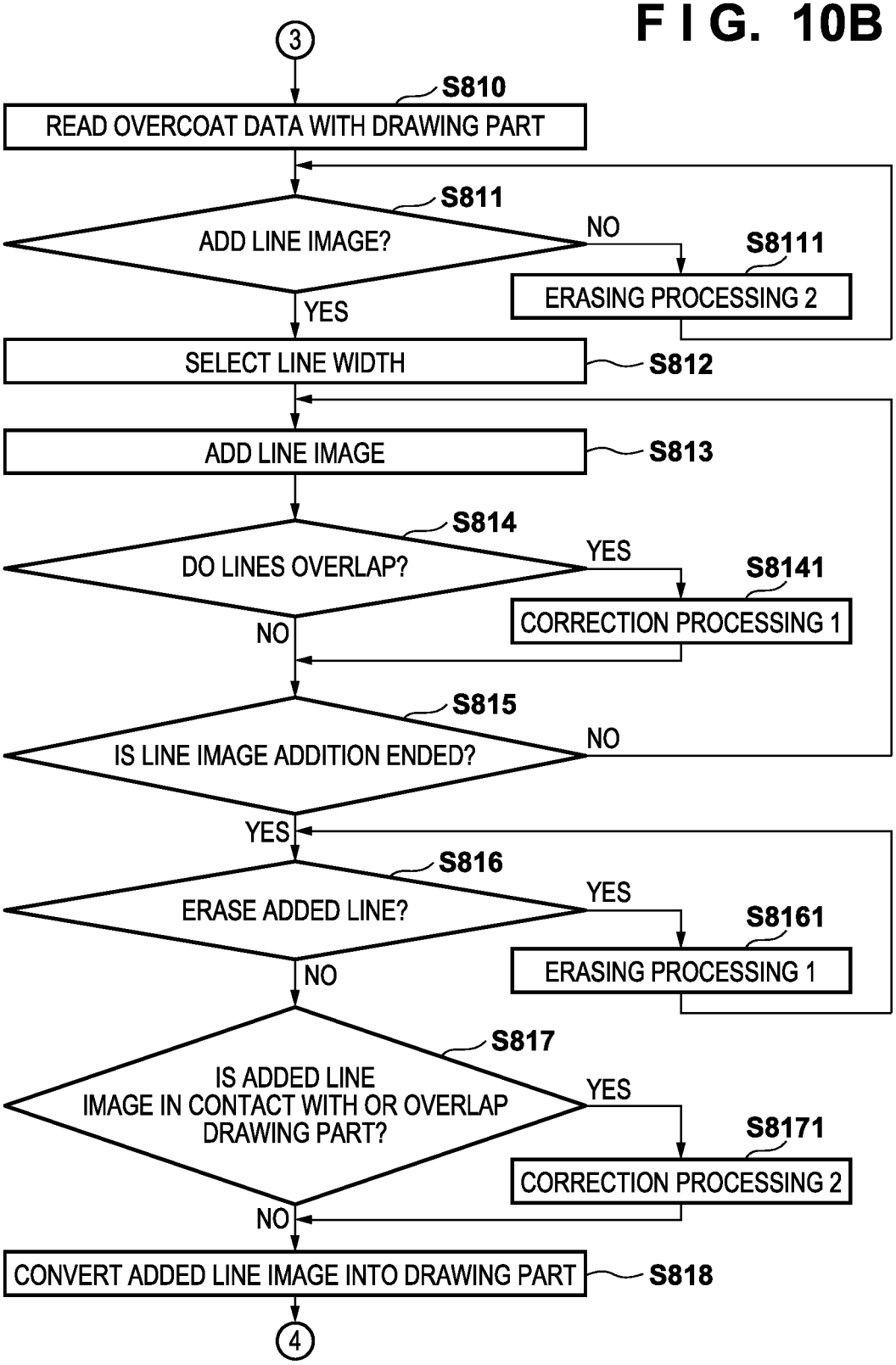

FIG. 7A is a diagram illustrating an example of a line image drawn by the user on the overcoat surface. FIGS. 7B and 7C are diagrams in which a part of the line image drawn by the user on the overcoat surface is enlarged. FIGS. 8A1, 8A2, 8A3, 8B1, 8B2, and 8B3, and FIGS. 9A1, 9A2, 9A3, 9A4, 9B1, 9B2, 9B3, 9B4, 9C1, 9C2, and 9C3 are diagrams for describing the image conversion processing for adding a line image to the overcoat as a drawing part. FIGS. 10A and 10B are flowcharts illustrating procedures of the image conversion processing for adding a line image generated by the user to the overcoat as a drawing part. Note that the processing in FIGS. 10A and 10B is realized by decompressing the programs stored in the non-volatile memory 603 to the working memory 604 and by the control unit 601 executing the programs and controlling the components of the host device 600. Furthermore, the processing in FIG. 10E is started when the editor software program of the host device 600 is launched.

In step S802, the control unit 601 determines whether the user will be newly generating a drawing part or will be editing an already generated drawing part. This determination is made in accordance with a selection operation performed by the user. In other words, the user can select, on the editor menu screen or the like, whether to newly generate a drawing part or to edit an already generated drawing part. The control unit 601 proceeds to the processing in step S803 when determining that the user has selected to newly generate a drawing part, and proceeds to the processing in step S810 when determining that the user has selected to edit an already generated drawing part.

In step S803, the control unit 601 determines the line width when the user newly generates a drawing part. This determination is made in accordance with a selection operation performed by the user. In other words, the user can select the line width for generating a drawing part.

In step S804, the control unit 601 draws, on the display unit/operation unit 602, a line image drawn by the user using the user's finger(s) or a stylus.

In step S805, the control unit 601 determines, in regard to the line image generated by the user in step S804, whether or not there are lines that overlap one another. The control unit 601 proceeds to the processing in step S8051 when determining that there are lines that overlap one another in step S804, and proceeds to the processing in step S806 when determining that there are no line that overlaps one another.

In step S8051, the control unit 601 performs processing (correction processing 1) for correcting the line image in which lines overlap one another in step S804.

The processing in which the user draws one line in step S804 is continued from when a touch-down on the touch panel is detected to when a touch-up is detected from a state in which a touch-on or a touch-move is being detected. While the user is drawing a line in step S804, the determination of whether or not a plurality of lines drawn by the user overlap one another, and in a case in which the lines are separated from one another, a determination of whether or not the distance between the lines is equal to or less than a predetermined number of pixels are continuously executed in step S805. Furthermore, in a case in which the plurality of lines drawn by the user overlap and it is determined that the distance between the lines is equal to or less than the predetermined number of pixels in step S805, processing proceeds to step S8051, where processing for appropriately correcting the lines that are separated from one another is performed. Correction processing 1 will be described in detail later with reference to FIGS. 8B1, 8B2, and 8B3.

In step S806, the control unit 601 determines whether or not the user has finished generating a line image. This determination is made based on an explicit operation by the user or whether a predetermined amount of time has elapsed without another touch-up being detected from when touch-up has been detected last during the generation of a line image. The control unit 601 proceeds to the processing in step S807 when determining that the user has finished generating a line image, and returns to the processing in step S804 when not determining that the user has finished generating a line image.

In step S807, the control unit 601 determines whether or not there is a line that the user wants to erase in the line image generated by the user in step S804. This determination is made in accordance with an erasing operation performed by the user. In order words, the user can designate and erase a desired line image using an editor erasing tool. The control unit 601 proceeds to the processing in step S8052 when determining that there is a line that the user wants to erase in the line image generated by the user in step S804, and proceeds to the processing in step S808 when determining that there is no line that the user wants to erase.

In step S8052, the control unit 601 erases the line that the user has designated as the erasing-target line (erasing processing 1). Erasing processing 1 will be described in detail later with reference to FIGS. 9A1, 9A2, 9A3, and 9A4.

In step S808, the control unit 601 performs processing for converting the line image generated by the user into a drawing part to be added to the overcoat.

In step S809, the control unit 601 stores overcoat data with a drawing part generated in step S808 to the nonvolatile memory 603, and terminates processing.

On the other hand, when determining in step S802 that an already generated drawing part will be edited, the control unit 601, in step S810, reads overcoat data with a drawing part stored in the non-volatile memory 603. In step S811, the control unit 601 determines whether the editing to be performed is the adding of a line image or the erasing of an already generated drawing part. The control unit 601 proceeds to the processing in step S812 when determining that the editing to be performed is the adding of a line image, and proceeds to the processing in step S8111 when determining that the editing to be performed is the erasing of a drawing part rather than the adding of a line image. This determination is made in accordance with a selection operation performed by the user. That is, the user can select, on the editor menu screen or the like, whether to add a line image or to erase a drawing part.

In step S8111, the control unit 601 performs processing for erasing the drawing part that the user has designated as the erasing-target drawing part (erasing processing 2).

In steps S812 and S813, the control unit 601 sets a line width designated by the user or a default line width, and adds a line image generated by the user.

In step S814, the control unit 601 determines whether or not there are lines that overlap one another as a result of the user having added a line image in step S813. The control unit 601 proceeds to the processing in step S8141 when determining that there are lines that overlap one another in step S813, and proceeds to the processing in step S815 when determining that there are no line that overlaps one another.

In step S8141, the control unit 601 performs processing (correction processing 1) for correcting the line image in which lines overlap one another in step S813.

The processing in which the user draws one line in step S813 is continued from when a touch-down on the touch panel is detected to when a touch-up is detected from a state in which a touch-on or a touch-move is being detected. While the user is drawing a line in step S813, the determination of whether or not a plurality of lines drawn by the user overlap one another, and in a case in which the lines are separated from one another, a determination of whether or not the distance between the lines is equal to or less than a predetermined number of pixels are continuously executed in step S814. Furthermore, in a case in which the plurality of lines drawn by the user overlap and it is determined that the distance between the lines is equal to or less than the predetermined number of pixels in step S814, processing proceeds to step S8141, where processing for appropriately correcting the lines that are separated from one another is performed. Correction processing 1 will be described in detail later with reference to FIGS. 8B1, 8B2, and 8B3.

In step S815, the control unit 601 determines whether or not the user has finished adding a line image. This determination is made based on an explicit operation by the user or whether a predetermined amount of time has elapsed without another touch-up being detected from when touch-up has been detected last during the generation of a line image. The control unit 601 proceeds to the processing in step S816 when determining that the user has finished adding a line image, and returns to the processing in step S813 when not determining that the adding of a line image has been finished.

In step S816, the control unit 601 determines whether or not there is a line that the user wants to erase in the line image added by the user in step S813. This determination is made in accordance with an erasing operation performed by the user. In order words, the user can designate and erase a desired line image using the editor erasing tool. The control unit 601 proceeds to the processing in step S8161 when determining that there is a line that the user wants to erase in the line image added by the user in step S813, and proceeds to the processing in step S817 when determining that there is no line that the user wants to erase.

In step S8161, the control unit 601 erases the line that the user has designated as the erasing-target line (erasing processing 1). Erasing processing 1 will be described in detail later with reference to FIGS. 9A1, 9A2, 9A3, and 9A4.

In step S817, the control unit 601 determines whether the line image added by the user in step S813 is in contact with or overlaps the already generated drawing part. The control unit 601 proceeds to the processing in step S8171 when determining that the added line image is in contact with or overlaps the already generated drawing part, and proceeds to the processing in step S818 when determining that the added line image is not in contact with or does not overlap the already generated drawing part.

In step S8171, the control unit 601 performs processing (correction processing 2) for erasing pixel data in an outline part and an area inside the outline part of the already generated drawing part that overlap the line image added by the user in step S813, and setting high-gloss areas corresponding to two pixels in areas of the erased drawing part outside the outline part of the line image. Correction processing 2 will be described in detail later with reference to FIGS. 9B1, 9B2, 9B3, 9B4, 9C1, 9C2, and 9C3.

In step S818, the control unit 601 performs processing for converting the line image added by the user into a drawing part to be added to the overcoat so as to be merged with the already generated drawing part, and proceeds to the processing in step S809.

<Description of Conversion Processing>

Next, the processing in steps S808 and S818 in FIGS. 1.0A and 10B for converting a line image into a drawing part will be described.

FIG. 7A illustrates an example of a line image 700 drawn by the user on the overcoat surface by applying the user's finger(s) or a stylus to the touch panel of the host device 600. FIG. 7B is a diagram in which a line 701 that is part of the line image 700 is enlarged. FIG. 7C illustrates an example of a drawing part 705 obtained through conversion from the line image in FIG. 7B.

As illustrated in FIG. 7A, the user can draw a line image 700 on the overcoat surface by applying the user's finger(s) or a stylus to the touch panel of the host device 600. The line 701 illustrated in FIG. 7B is a part of a character or a drawing handwritten by the user in a predetermined line width. Reference numeral "702" indicates a no-drawing area around the line 701. As illustrated in FIG. 7C, the line 701 illustrated in FIG. 7B is converted into a drawing part 705 and a no-drawing part 7021. The drawing part 705 includes an outline part 703, which is formed from pixels (low-gloss pixels) having a first glossiness, and a mixed pattern part 704, in which pixels in the area inside the outline part 703 consisting of pixels having the first glossiness and pixels (high-gloss pixels) having a second glossiness higher than the first glossiness are mixed. The no-drawing part 7021 is formed from pixels in the area outside the drawing part 705. By surrounding the mixed pattern part 704, the outline part 703 has the effect of emphasizing the edge of the line image 700 and improving the visibility of the drawing part 705 on the overcoat surface. In the mixed pattern part 704, high-gloss pixels and low-gloss pixels are dispersed and arranged in an appropriate ratio so as to prevent the occurrence of overcoat separation failure while reducing gloss. Since the outline part 703 surrounding the mixed pattern part 704 is formed to have a minimum width of one pixel and the mixed pattern part 704 is formed to have a minimum width of two pixels, the minimum line width is four pixels. If the outline part 703 were provided with a pixel width of two or more pixels, visibility would improve but the risk increases of overcoat separation failure occurring when the number of lines 701 would increase. Furthermore, if the mixed pattern part 704 were set to one pixel or less, the visibility of the drawing part 705 on the overcoat surface would decrease because low-gloss pixels cannot be arranged.

FIGS. 8A1, 8A2, and 8A3 are diagrams for describing processing in a case in which two lines are in contact with one another, with FIGS. 8A1 and 8A2 illustrating line images drawn on the touch panel, and FIG. 8A3 illustrating a drawing part obtained through conversion from the line images. A line 805 and a line 806 are arranged in contact with one another without any space therebetween in FIGS. 8A1 and 8A2, and thus the lines 805 and 806 are converted into a drawing part 807 as one line image, as illustrated in FIG. 8A3. Reference numerals "8071", "8072", and "8073" respectively indicate the outline part, the mixed pattern part, and the area outside the drawing part.

FIGS. 8B1, 8B2, and 8B3 are diagrams for describing correction processing 1 (steps S8051 and S8141 in FIGS. 10A and 10B) in a case in which two lines are separated from one another. FIGS. 8B1 and 8B2 illustrate line images drawn on the touch panel, and FIG. 8B3 illustrates drawing parts obtained through conversion from the line images. Since a line 808 and a line 809 are separated from one another in FIGS. 8B1 and 8132, the distance between the lines is determined (step S805 in FIG. 10A). Furthermore, when the distance between the lines is less than two pixels, the two lines are determined as overlapping one another, and correction processing 1 in step S8051 in FIG. 10A is performed to correct pixels of the line 809 drawn later so that the distance between the lines is more than or equal to two pixels. As illustrated in FIG. 8B2, a deletion area 809*a* is provided in pixels of the line 809 drawn later that are close to the line 808 drawn earlier, data of pixels corresponding to the deletion area 809*a* of the line 809 is erased, and conversion is performed into separate drawing parts 810 and 811 such that the distance between the lines 808 and 809 is more than or equal to two pixels as illustrated in FIG. 8133.

FIGS. 9A1, 9A2, 9A3, and 9A4 are diagrams for describing erasing processing 1 (steps S8052 and S8161 in FIGS. 10A and 108) for erasing some lines in a line image or erasing processing 2 (steps S8111 in FIG. 10B) for erasing some already generated drawing parts. FIGS. 9A1, 9A2, and 9A3 illustrate a line image drawn on the touch panel or already generated drawing parts, and FIG. 9A4 illustrates a drawing part obtained through conversion from the line image. In a case in which the user wants to erase a line or already generated drawing part 913 from lines or already generated drawing parts 912 and 913 as illustrated in FIG. 9A1, when the user selects the line or already generated drawing part 913 on the screen and executes deletion as illustrated in FIG. 9A2, the line or already generated drawing part 913 is deleted as illustrated in FIG. 9133. After the line or already generated drawing part 913 is deleted, the line 912 is converted into a drawing part or only the already generated drawing part 912 remains as illustrated in FIG. 9B4.

FIGS. 9B1, 9B2, 9B3, and 9134 are diagrams for describing processing (step S8171 in FIG. 10B) in a case in which a line 915 is in contact with an already generated drawing part 914. FIGS. 9B1, 9B2, and 9B3 illustrate a line image added to an already generated drawing part, and FIG. 9B4 illustrates drawing parts obtained through conversion from the already generated drawing part and the added line image. As illustrated in FIG. 9B3, a deletion area 915*a* is provided in pixels of the line 915, which has been added as illustrated in FIG. 9B2 to the already generated drawing part 914 illustrated in FIG. 9B1, that are close to the already generated drawing part 914. Furthermore, as illustrated in FIG. 9B4, data of pixels corresponding to the deletion area 915*a* of the line 915 are erased, and conversion is performed into a drawing part 917 such that the distance from the already generated drawing part 914 is more than or equal to two pixels.

FIGS. 9C1, 9C2, and 9C3 are diagrams for describing processing (step S81.71 in FIG. 10B) in a case in which a line 919 overlaps a drawing part 918. FIGS. 9C1 and 9C2 illustrate a line image added to an already generated drawing part, and FIG. 9C3 illustrates drawing parts obtained through conversion from the already generated drawing part and the added line image. In a case in which the added line 919 overlaps the already generated drawing part 918 as illustrated in FIG. 9C 1, a second outline part 918*a* formed from high-gloss pixels is formed in the drawing part 918 at an area around the overlapping line 919 that overlaps the line 919 as illustrated in FIG. 9C2, and conversion is performed into separate drawing parts 920 and 921. Thus, the drawing part 921 is arranged on the already generated drawing part 920 as illustrated in FIG. 9C3, and the excessive continuation of low-gloss pixels can be prevented.

Spaces are provided between line images and between an already generated drawing part and a line image in order to reduce portions where low-gloss pixels continue as much as possible and mitigate overcoat separation failure.

<Glossiness and Gradation During Overcoat Transfer According to Present Embodiment, and Formation Method and Pixel Ratio of Mixed Pattern Part>

Next, glossiness and gradation during overcoat transfer according to the present embodiment, and the pixel ratio of the mixed pattern part will be described with reference to FIGS. 11A to 11C, and FIGS. 12A and 12B.

Figure 11A:
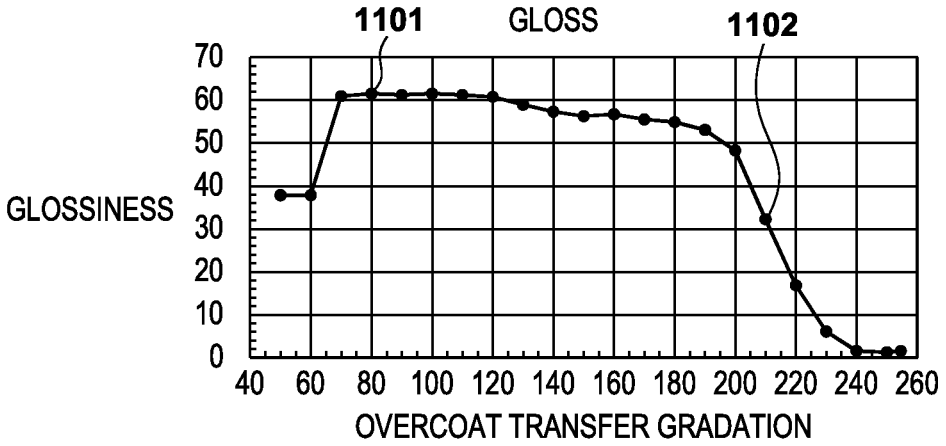
FIGS. 11A to 11C are diagrams illustrating examples of the relationship between glossiness and gradation during overcoat transfer according to the present embodiment, and the pixel ratio of a mixed pattern part.

FIG. 11A illustrates the relationship between glossiness and gradation during overcoat transfer. Gradation during overcoat transfer is expressed in 256 gradations, and the higher the gradation value, the greater the energy during overcoat transfer. The gradation during transfer of an overcoat with a drawing part is such that: areas outside the outline part and high-gloss pixels 1101 in the mixed pattern part, which is the area inside the outline part, have a gradation value within the range of approximately 80 to 180; and the outline part and low-gloss pixels 1102 in the mixed pattern part have a gradation value within the range of approximately 210 to 230. Furthermore, the glossiness of an overcoat surface transferred with a gradation value of 210 to 230 is 35 or less, the glossiness of an overcoat surface transferred with a gradation value of 80 to 180 is 50 or more, and the glossiness of an overcoat surface on which a mixed pattern part is transferred is 35 to 50.

Figure 11B:
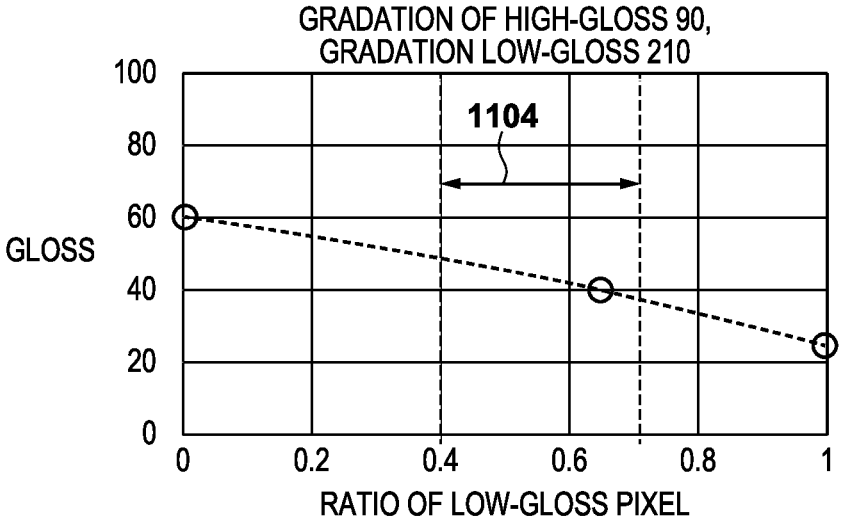
Figure 11C:
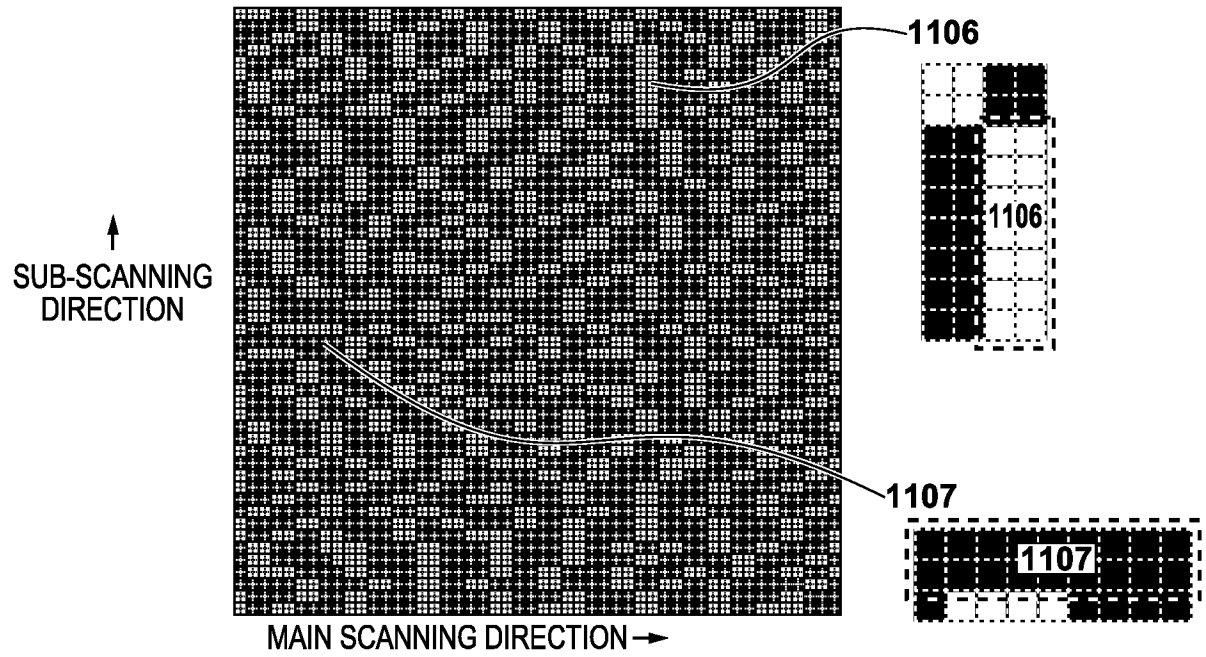

FIG. 11B illustrates an example of the relationship between glossiness and the ratio of low-gloss pixels in the mixed pattern part. The maximum of the ratio 1104 of the low-gloss pixels 1102 in the mixed pattern part is 40-75%, and conversely, the maximum of the ratio of the high-gloss pixels 1101 is 60-25%. Furthermore, the mode, the average, and the maximum of the number of the low-gloss pixels 1102 that can be continuously arranged in the mixed pattern part is three pixels, five pixels, and forty pixels, respectively, in the main scanning direction and the sub-scanning direction. Similarly, the mode and the average of the number of the high-gloss pixels 1101 that can be continuously arranged in the mixed pattern part are two pixels, and the maximum of the number of high-gloss pixels 1101 that can be continuously arranged in the mixed pattern part is twenty-five pixels. The high-gloss pixels 1101 and the low-gloss pixels 1102 in the mixed pattern part are arranged in a dispersed state. FIG. 11C illustrates an example arrangement of the mixed pattern part. In the mixed pattern part 1104, low-gloss pixels and high-gloss pixels are arranged in an appropriate ratio, distribution, and continuity. For example, a partial area 1106 in the mixed pattern part is an example in which two high-gloss pixels 1101 are continuously arranged in the main scanning direction and seven high-gloss pixels 1101 are continuously arranged in the sub-scanning direction. Furthermore, for example, a partial area 1107 in the mixed pattern part is an example in which nine low-gloss pixels 1102 are continuously arranged in the main scanning direction and two low-gloss pixels 1102 are continuously arranged in the sub-scanning direction. By arranging low-gloss pixels 1102 or high-gloss pixels 1101 as rectangular unit blocks having an arbitrarily defined size so as to have an appropriate ratio, distribution, and continuity in such a manner, an overcoat in which the visibility of a drawing part is ensured can be transferred while preventing the occurrence of overcoat separation failure caused by excessive roughening of the overcoat surface.

Figure 12A:
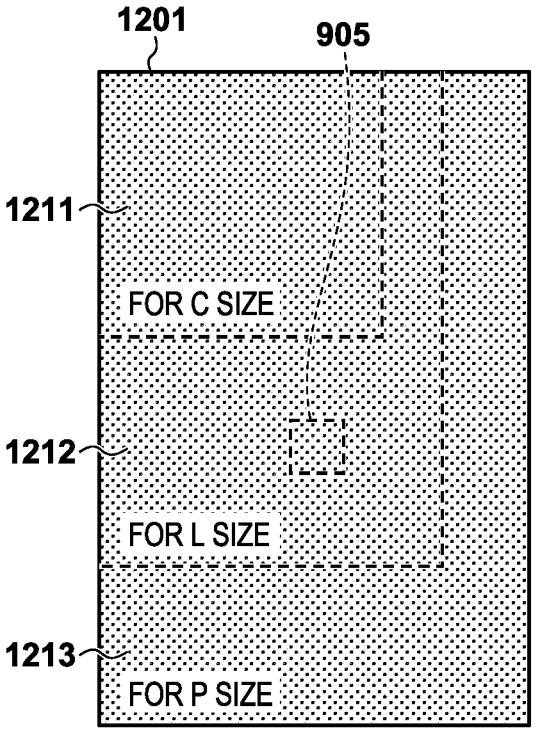
FIGS. 12A and 12B are diagrams for describing a method for forming mixed pattern parts for different recording sheet sizes according to the present embodiment.
Figure 12B:
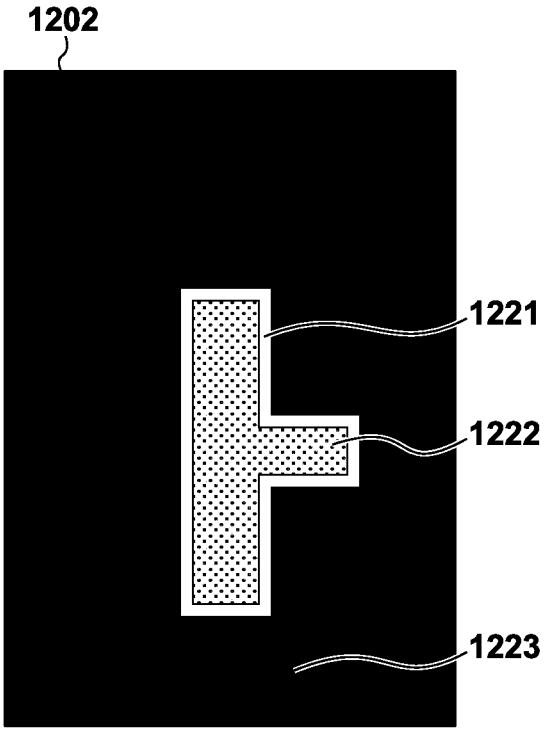

FIGS. 12A and 12B are diagrams for describing a method for forming mixed pattern parts for different recording sheet sizes according to the present embodiment.

Upon transfer of overcoats with drawing parts, mixed pattern parts generated in advance for recording sheets 113 of different sizes are used, and areas to be used as mixed pattern parts are varied in accordance with the recording sheets 113. FIG. 12A illustrates areas used as mixed pattern parts 1201 for recording sheets 113 of the C (1211), L (1212), and P (1213) sizes. FIG. 12B illustrates a case in which transfer has been performed using a drawing-part mixed pattern part corresponding to a P-size recording sheet 113. The mixture pattern part in FIG. 12A is arranged on a base plane 1202 for the drawing-part mixed pattern part corresponding to a P-size recording sheet 113, and areas other than an outline part 1221 obtained through conversion from line images and an area 1223 outside the outline part 1221 are cut away, whereby a mixed pattern part 1222 on the base plane is exposed and a drawing part on the overcoat is formed.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™, a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-98919, filed Jun. 14, 2021 which is hereby incorporated by reference herein in its entirety.

What is claimed is:

1. An image processing apparatus that generates overcoat transfer data for transferring an overcoat, by a printing unit, onto an image formed on a recording sheet, the image processing apparatus comprising:

a drawing unit configured to generate a line image to be added to the overcoat; and an image processing unit configured to convert the line image into a drawing part to be added to the overcoat, and generate overcoat transfer data to be transferred onto the recording sheet by the printing unit, wherein the drawing part includes an outline part and an area inside the outline part, the outline part is formed from pixels having a first glossiness, the area inside the outline part is formed as a mixed pattern part in which pixels having the first glossiness and pixels having a second glossiness higher than the first glossiness are mixed, and the area outside the outline part is formed from pixels having the second glossiness.

2. The apparatus according to claim 1, wherein when first and second line images are in contact with or overlap one another, the image processing unit converts the first and second line images into a drawing part as a single line image, and when the first and second line images are separated from one another, the image processing unit corrects the second line image so that the distance from the first line image is more than or equal to a predetermined number of pixels and performs conversion into drawing parts.

3. The apparatus according to claim 2, wherein the outline part surrounding the mixed pattern part is formed so as to have a minimum width of one pixel, the mixed pattern part is formed to have a minimum width of two pixels, and the line image is formed to have a minimum width of four pixels, and the predetermined number of pixels is two.

4. The apparatus according to claim 1, wherein in a case in which a first line image has been added to an already generated first drawing part:

when the first drawing part and the first line image do not overlap one another, the image processing unit performs cone-non so that the distance between the first drawing part and the first line image is equal to or greater than a predetermined number of pixels and performs conversion into drawing parts; and when the first drawing part and the first line image overlap one another, the image processing unit forms a second outline part formed from pixels having the second glossiness in the first drawing part in an area outside the first line image overlapping with the first line image and performs conversion into drawing parts.

5. The apparatus according to claim 1, wherein the drawing unit s capable of selecting a line image to be erased from among a plurality of line images, or is capable of selecting a drawing part to be erased from among a plurality of already generated drawing parts.

6. The apparatus according to claim 1, wherein in the mixed pattern part, pixels having the first glossiness and pixels having the second glossiness are dispersed and arranged in a predetermined ratio such that:

the maximum of the ratio of pixels having the first glossiness is 40-75%, and the mode, the average, and the maximum of the number of pixels having the first glossiness that are continuous in a main scanning direction and a sub-scanning direction during overcoat transfer are three pixels, five pixels, and forty pixels, respectively; and the ratio of pixels having the second glossiness is 60-25%, the mode and the average of the number of continuous pixels having the second glossiness is two pixels, and the maximum of the number of continuous pixels having the second glossiness is twenty-five pixels.

7. The apparatus according to claim 1, wherein the glossiness of the drawing part in the overcoat transfer data is expressed in 256 gradations, and the greater the gradation value, the greater the energy during overcoat transfer, and pixels having the first glossiness have a first gradation value within the range of 210-230, and pixels having the second glossiness have a second gradation value within the range of 80-180.

8. The apparatus according to claim 1, wherein the glossiness of an overcoat surface transferred with pixels having the first glossiness is 35 or less, the glossiness of an overcoat surface transferred with pixels having the second glossiness is 50 or more, and the glossiness of an overcoat surface on which the mixed pattern part, in which pixels having the first glossiness and pixels having the second glossiness are mixed, is transferred is 35-50.

9. The apparatus according to claim 1, further comprising a touch panel, wherein the drawing unit generates a line image to be added to an overcoat, in accordance with a user operation on the touch panel.

10. The apparatus according to claim 1, wherein the image processing apparatus further comprises the printing unit.

11. The apparatus according to claim 1, further comprising a transmission unit configured to transmit the overcoat transfer data generated by the image processing unit to an external printing apparatus that includes the printing unit.

12. A method of controlling an image processing apparatus that generates overcoat transfer data for transferring an overcoat onto an image formed on a recording sheet, the method comprising:

generating a line image to be added to the overcoat; and converting the line image into a drawing part to be added to the overcoat, and generating overcoat transfer data to be transferred onto a recording sheet by a printing apparatus, wherein the drawing part includes an outline part and an area inside the outline part, the outline part is formed from pixels having a first glossiness, and the area inside the outline part is formed as a mixed pattern part in which pixels having the first glossiness and pixels having a second glossiness higher than the first glossiness are mixed, and the area outside the outline part is formed from pixels having the second glossiness.

13. A non-transitory computer-readable storage medium storing a program for causing a computer to function as each unit of an image processing apparatus that generates overcoat transfer data for transferring an overcoat, by a printing unit, onto an image formed on a recording sheet, the image processing apparatus comprising:

a drawing unit configured to generate a line image to be added to the overcoat; and an image processing unit configured to convert the line image into a drawing part to be added to the overcoat, and generate overcoat transfer data to be transferred onto the recording sheet by the printing unit, wherein the drawing part includes an outline part and an area inside the outline part, the outline part is formed from pixels having a first glossiness, the area inside the outline part is formed as a mixed pattern part in which pixels having the first glossiness and pixels having a second glossiness higher than the first glossiness are mixed, and the area outside the outline part is formed from pixels having the second glossiness.

14. A non-transitory computer-readable storage medium storing a program for causing a computer to execute a method of controlling an image processing apparatus that generates overcoat transfer data for transferring an overcoat onto an image formed on a recording sheet, the method comprising:

generating a line image to be added to the overcoat; and converting the line image into a drawing part to be added to the overcoat, and generating overcoat transfer data to be transferred onto a recording sheet by a printing apparatus, wherein the drawing part includes an outline part and an area inside the outline part, the outline part is formed from pixels having a first glossiness, and the area inside the outline part is formed as a mixed pattern part in which pixels having the first glossiness and pixels having a second glossiness higher than the first glossiness are mixed, and the area outside the outline part is formed from pixels having the second glossiness.

* * * * *